US009601861B2

(12) United States Patent
Kanamori

(10) Patent No.: US 9,601,861 B2
(45) Date of Patent: Mar. 21, 2017

(54) CHARGING CONNECTOR CONNECTING DEVICE

(71) Applicant: TOYOTA JIDOSHA KABUSHIKI KAISHA, Toyota-shi, Aichi-ken (JP)

(72) Inventor: Takashi Kanamori, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/155,679

(22) Filed: May 16, 2016

(65) Prior Publication Data

US 2016/0344131 A1 Nov. 24, 2016

(30) Foreign Application Priority Data

May 20, 2015 (JP) ..... 2015-102765

(51) Int. Cl.
*H01R 13/453* (2006.01)
*H01R 13/627* (2006.01)

(52) U.S. Cl.
CPC ..... *H01R 13/4532* (2013.01); *H01R 13/6272* (2013.01); *H01R 2201/26* (2013.01)

(58) Field of Classification Search
CPC ..... H01R 13/4532; H01R 13/4536; H01R 13/447; H01R 27/00; H01R 31/06
USPC ..... 439/138, 137, 218, 217
See application file for complete search history.

(56) References Cited

U.S. PATENT DOCUMENTS 5,716,224 A * 2/1998 Masuda ..... H01R 13/4536 439/138
5,885,095 A * 3/1999 Cohen ..... H01R 13/4532 439/138
6,595,696 B1 * 7/2003 Zellak ..... G02B 6/3825 385/72
8,376,760 B1 * 2/2013 Kostrzewski ..... H01R 13/4538 235/493
2007/0117428 A1 * 5/2007 Mossner ..... H01R 13/447 439/138

FOREIGN PATENT DOCUMENTS

JP 2013-212001 A 10/2013
JP 2014-230301 A 12/2014
WO 2014/184729 A2 11/2014

* cited by examiner

*Primary Examiner* — Gary Paumen
(74) *Attorney, Agent, or Firm* — Oliff PLC

(57) ABSTRACT

A charging connector connecting device includes a cover that is movable between a closed position at which a connecting portion is closed and an open position at which the connecting portion is opened so that a second charging connector can be connected to the connecting portion; an elastic member that applies a biasing force to the cover so that the cover is positioned at an initial position between the closed position and the open position; and a pressing member configured to move with insertion of a first charging connector into the connecting portion so as to press the cover positioned at the initial position to thereby move the cover to the closed position.

8 Claims, 16 Drawing Sheets

CHARGING CONNECTOR CONNECTING DEVICE

INCORPORATION BY REFERENCE

The disclosure of Japanese Patent Application No. 2015-102765 filed on May 20, 2015 including the specification, drawings and abstract is incorporated herein by reference in its entirety.

BACKGROUND

1. Technical Field

The disclosure relates to a charging connector connecting device.

2. Description of Related Art

In recent years, a combo system (SAEJ2847/2 or IEC61851-23) has been known as a standard for use in a quick charge system. A DC charging connector of the combo system includes a communication portion and a DC charging terminal portion including a 2-pin terminal for DC charging. The communication portion has a shape that is the same as an AC charging connector (SAEJ1772 or IEC62169-2Type2).

A charging connector connecting device corresponding to the charging connector of the combo system includes a first connecting portion corresponding to the communication portion, and a second connecting portion corresponding to the 2-pin terminal of the DC charging connector.

When the DC charging connector of the combo system is connected to the charging connector connecting device, the communication portion is inserted into the first connecting portion, and the DC charging terminal portion is inserted into the second connecting portion. When an AC connector is connected, the AC connector is inserted into the first connecting portion, and the second connecting portion is exposed.

Generally, in the charging connector connecting device including two connecting portions, various structures have been proposed to prevent the other connecting portion from being exposed to the outside when a connector is connected to only one connecting portion.

A charging connector connecting device described in Japanese Patent Application Publication No. 2013-212001 (JP 2013-212001 A) includes: a quick charge connecting portion to which a quick charge connector is connected; a home-use connecting portion to which a normal charge connector is connected; and a connection preventing portion that prevents a connection of the other charging connector when one charging connector is connected.

The connection preventing portion includes: a swinging portion provided on a back-face side of the connecting portion; a first movable portion provided on one end side of the swinging portion and provided on a back-face side of the quick charge connecting portion; and a second movable portion provided on the other end side of the swinging portion and provided on a back-face side of the home-use connecting portion. The first movable portion includes a projecting portion rotatably provided in a tip end of the first movable portion so as to be positioned around the quick charge connecting portion, and a spring that biases the projecting portion so as to be closed.

The second movable portion includes a projecting portion rotatably provided in a tip end of the second movable portion so as to be placed around the home-use connecting portion, and a spring that biases the projecting portion so as to be closed.

When the quick charge connector is connected to the quick charge connecting portion, the quick charge connector pushes the first movable portion, and when the first movable portion is pushed, the swinging portion rotates, so that the second movable portion is pushed up. When the second movable portion is pushed up, the projection portion provided in the tip end of the second movable portion closes an opening of the home-use connecting portion due to a biasing force of the spring.

Similarly, when the normal charge connector is connected to the home-use connecting portion, the normal charge connector pushes the second movable portion. When the second movable portion is pushed, the swinging portion rotates, so that the first movable portion is pushed up. When the first movable portion is pushed up, the projection portion provided in the first movable portion closes the quick charge connecting portion due to a biasing force of the spring.

In the charging connector connecting device described in JP 2013-212001 A, each projecting portion closes each connecting portion due to the biasing force of the spring. On this account, even in a state where the quick charge connector is connected to the quick charge connecting portion so that the home-use connecting portion is closed by the projecting portion, for example, the projecting portion can be opened against the biasing force of the spring.

The inventors have studied a case where the structure described in JP 2013-212001 A is applied to a charging connector connecting device of the combo system.

More specifically, the inventors have studied a case where a first movable portion is placed in a first connecting portion of the charging connector connecting device of the combo system, and a second movable portion is placed in a second connecting portion thereof.

In this case, when an AC charging connector is connected to the first connecting portion of the charging connector connecting device of the combo system, the second connecting portion is closed by a projecting portion. However, even in this case, the projecting portion can be opened against a biasing force of the spring that biases the projecting portion to the position at which it closes the second connecting portion.

Further, when a DC charging connector of the combo system is connected to the charging connector connecting device, a DC charging terminal portion of the DC charging connector pushes the second movable portion, so that the second movable portion is projected over a first connector. This results in a communication portion of the DC charging connector not being able to be inserted into the first connector.

SUMMARY

The embodiments provide a charging connector connecting device including a first connecting portion and a second connecting portion and configured such that either a first charging connector to be inserted into the first connecting portion or a second charging connector to be inserted into the first connecting portion and the second connecting portion is connected thereto, and the charging connector connecting device is configured such that each of the charging connectors can be successfully connected to the charging connector connecting device, and when the first charging connector is connected, the second connecting portion can be closed successfully.

Further, the embodiments provide a charging connector connecting device including a first connecting portion and a second connecting portion, and the charging connector connecting device is configured such that respective charging connectors can be connected to the first connecting portion and the second connecting portion, and when a charging connector is connected to one of the connecting portions, a cover for the other one of the connecting portions can be closed successfully.

A charging connector connecting device according to a first aspect includes: a connector connecting portion including a first connecting portion and a second connecting portion, the connector connecting portion being configured to be selectively connected to either a first charging connector that is inserted into the first connecting portion or a second charging connector that is inserted into the first connecting portion and the second connecting portion; a cover that is movable between a closed position at which the second connecting portion is closed and an open position at which the second connecting portion is opened for connection to the second charging connector; an elastic member configured to apply a biasing force to the cover so that the cover is positioned at an initial position between the closed position and the open position; and a pressing member configured to move with insertion of the first charging connector into the connector connecting portion so as to press the cover positioned at the initial position to thereby move the cover to the closed position. When the first charging connector is connected to the first connecting portion, the pressing member engages the cover to maintain the cover at the closed position.

According to the charging connector connecting device, when the first charging connector is inserted, the pressing member moves the cover to the closed position. Thus, when the first charging connector is connected, it is possible to restrain the second connecting portion from being exposed to the outside. Further, when the second charging connector is inserted, the second charging connector can be connected to the charging connector connecting device by inserting the second charging connector in a state where the cover is positioned at the open position. Further, in a state where the first charging connector is connected to the first connecting portion, the pressing member presses the cover so that the cover is maintained at the closed position. Accordingly, even if an external force is applied to the cover, the cover is restrained from being opened.

The pressing member is configured to move with insertion of the second charging connector while the cover is positioned at the open position so as to be distanced (spaced) from the cover positioned at the open position.

According to the above configuration, when the second charging connector is inserted, the cover is positioned at the open position. Accordingly, in a case where the second charging connector is inserted, even if the pressing member moves, the pressing member does not make contact with the cover, thereby making it possible to restrain the cover from moving toward the closed position. As a result, it is possible to restrain the cover from interfering with the second charging connector.

The charging connector connecting device may preferably further include: an arm provided on a back-face side of the connector connecting portion, the back-face side being opposite to a front-face side of the connector connecting portion into which the first charging connector and the second charging connector are selectively inserted; a support configured to swingably support the arm; and a projection provided in the arm so as to project from the arm such that the projection projects toward the front-face side from the back-face side of the connector connecting portion. The pressing member may be provided on an opposite side of the support relative to the projection. The projection may be provided at a position where the projection is pressed by the first charging connector or the second charging connector when inserted into the connector connecting portion. The arm may be configured to rotate when the projection is pressed by the first charging connector or the second charging connector, to cause the pressing member to move in a direction toward the front-face side from the back-face side. The pressing member may be configured to move in the direction toward the front-face side from the back-face side to press the cover positioned at the initial position.

According to the above configuration, the cover positioned at the closed position is supported, via the pressing member, the arm, and the projection, by the charging connector inserted into the connector connecting portion. Thus, even if an external force is applied to the cover positioned at the closed position, it is possible to restrain the cover from being opened as long as the charging connector is inserted into the connector connecting portion.

The cover may be preferably rotatably attached to a lower end side of the second connecting portion, and the cover positioned at the initial position may be in a state where its upper end is distanced (spaced) from the second connecting portion.

According to the above configuration, an upper end of the cover is opened. Accordingly, when the second charging connector is inserted, a user can easily open the cover.

The cover may preferably include support walls that support side faces of the second charging connector. According to the above configuration, the second charging connector can be easily inserted.

The charging connector connecting device may preferably further include: a detector configured to detect that the first charging connector or the second charging connector is inserted into the connector connecting portion; and an actuator configured to move the pressing member. The connector connecting portion may include a front face into which the first charging connector or the second charging connector is inserted, and a back face positioned on an opposite side to the front face. The actuator may be configured to move the pressing member from the back-face side toward the front-face side when the first charging connector or the second charging connector is inserted into the connector connecting portion.

According to the above configuration, a driving force from the actuator is transmitted, via the pressing member, to the cover positioned at the closed position, and even if an external force is applied to the cover positioned at the closed position, it is possible to restrain the cover from being opened.

A charging connector connecting device according to a second aspect includes: a connector connecting portion including a first connecting portion configured to connect to a first charging connector, and a second connecting portion configured to connect to a second charging connector; a second connecting portion cover that is movable between a closed position at which the second connecting portion is closed and an open position at which the second connecting portion is opened for connection to the second charging connector, a second cover elastic member configured to apply a biasing force to the second connecting portion cover so that the second connecting portion cover is positioned at an initial position between the closed position and the open position; and a second cover pressing member configured to move with insertion of the first charging connector into the first connecting portion, so as to press the second connecting portion cover positioned at the initial position to thereby move the second connecting portion cover to the closed position. The second cover pressing member is configured such that, when the first charging connector is connected to the first connecting portion, the second cover pressing member engages the second connecting portion cover to maintain the second connecting portion cover at the closed position.

According to the above configuration, when the first charging connector is connected to the first connecting portion, the second connecting portion cover closes the second connecting portion. Furthermore, since the second cover pressing member engages the second connecting portion cover positioned at the closed position, even if an external force is applied to the second connecting portion cover, the second connecting portion cover is restrained from being opened.

The charging connector connecting device may preferably further include: a first connecting portion cover that is movable between a closed position at which the first connecting portion is closed and an open position at which the first connecting portion is opened for connection to the first charging connector; a first cover elastic member configured to apply a biasing force to the first connecting portion cover so that the first connecting portion cover is positioned at an initial position between the closed position of the first connecting portion cover and the open position of the first connecting portion cover; and a first cover pressing member configured to move with insertion of the second charging connector into the second connecting portion, so as to press the first connecting portion cover positioned at the open position of the first connecting portion cover to thereby move the first connecting portion cover to the closed position of the first connecting portion cover. When the second charging connector is connected to the second connecting portion, the first cover pressing member engages the first connecting portion cover to maintain the first connecting portion cover at the closed position of the first connecting portion cover.

According to the above configuration, when the second charging connector is connected to the second connecting portion, the first connecting portion cover closes the first connecting portion. Furthermore, since the first cover pressing member engages the first connecting portion cover positioned at the closed position, even if an external force is applied to the first connecting portion cover, it is possible to restrain the first connecting portion cover from being opened.

With the charging connector connecting device according to the above-described aspects, it is possible to successfully connect the charging connectors to the charging connector connecting device, and when the first charging connector is connected, the second connecting portion can be closed successfully.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Embodiment 1

Figure 1:
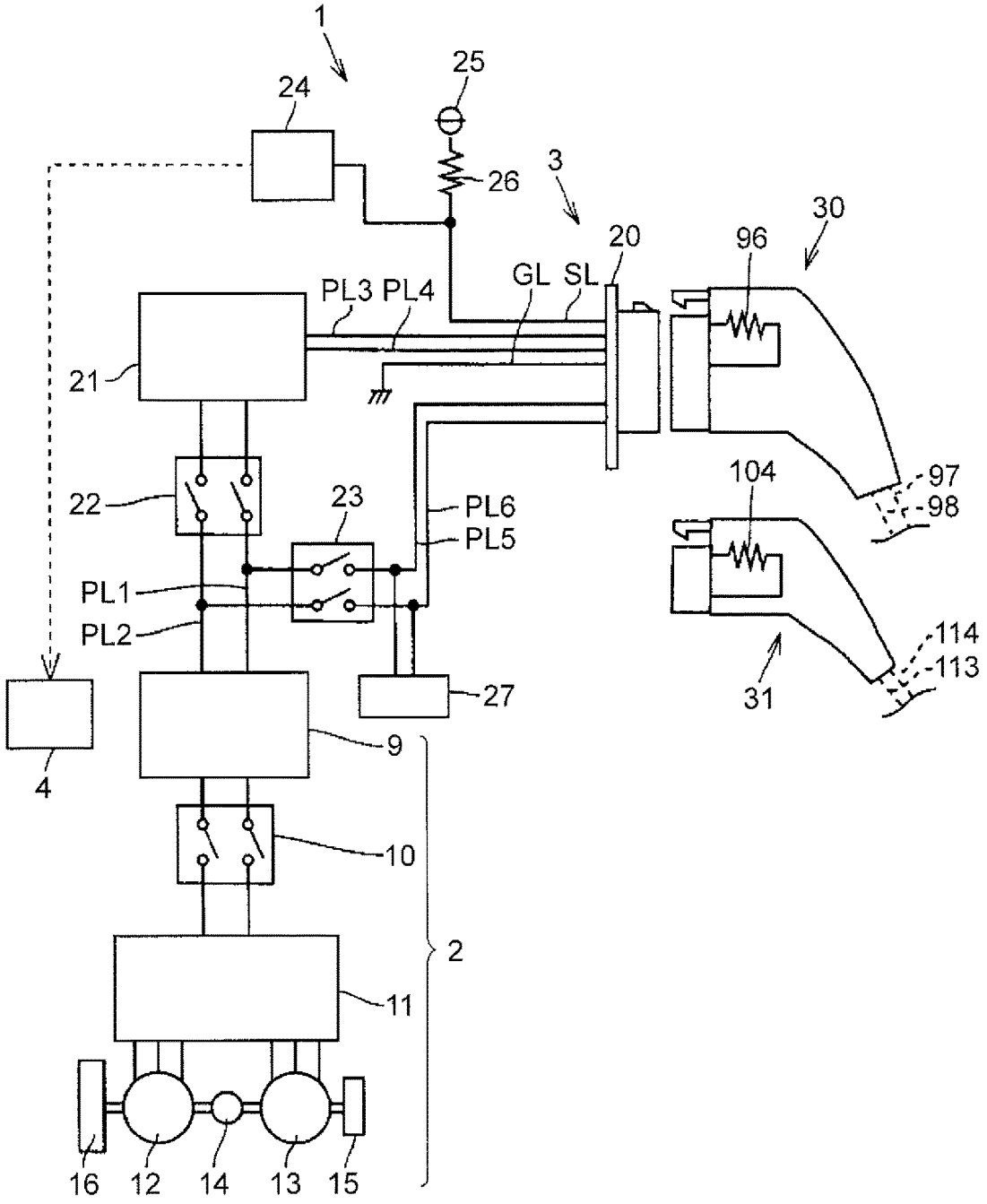
FIG. 1 is a block diagram illustrating a system configuration of a vehicle 1.

With reference to FIGS. 1 to 19, the following describes a vehicle including a charging connector connecting device according to Embodiment 1.

A vehicle 1 includes: an HV system 2 that generates a driving force for a wheel assembly 16; a charging system 3 that charges a battery 9 with an electric power from outside; and an ECU 4 that controls the HV system 2, the charging system 3, and so on.

The HV system 2 includes a system main relay 10 connected to the battery 9, a PCU (Power Control Unit) 11, a rotary electric machine 12 and a rotary electric machine 13 connected to the PCU 11, a power distribution mechanism 14, and an engine 15.

The charging system 3 includes a charging connector connecting device 20, a charger 21, an AC charging relay 22, a DC charging relay 23, a voltage sensor 24, a pull-up power supply 25, a resistor 26, and a voltage sensor 27. A DC charging connector 30 or an AC charging connector 31 is connected to the charging connector connecting device 20.

The charger 21 is connected to the battery 9 via a power line PL1 and a power line PL2. The AC charging relay 22 is provided in the power lines PL1, PL2. The charger 21 is connected to the charging connector connecting device 20 via a power line PL3 and a power line PL4.

The DC charging relay 23 is provided in power lines PL5, PL6 branched from the power lines PL1, PL2, and the power lines PL5, PL6 are connected to the charging connector connecting device 20. The voltage sensor 27 is connected to the power lines PL5, PL6 placed between the DC charging relay 23 and the charging connector connecting device 20.

A predetermined voltage is applied to the pull-up power supply 25, and the resistor 26 is provided between the charging connector connecting device 20 and the pull-up power supply 25. Note that the pull-up power supply 25 is connected to one end of the resistor 26, and a signal line SL connected to the charging connector connecting device 20 is connected to the other end of the resistor 26. The voltage sensor 24 measures a voltage of the signal line SL between the resistor 26 and the charging connector connecting device 20. Note that a ground line GL is connected to the charging connector connecting device 20.

Figure 2:
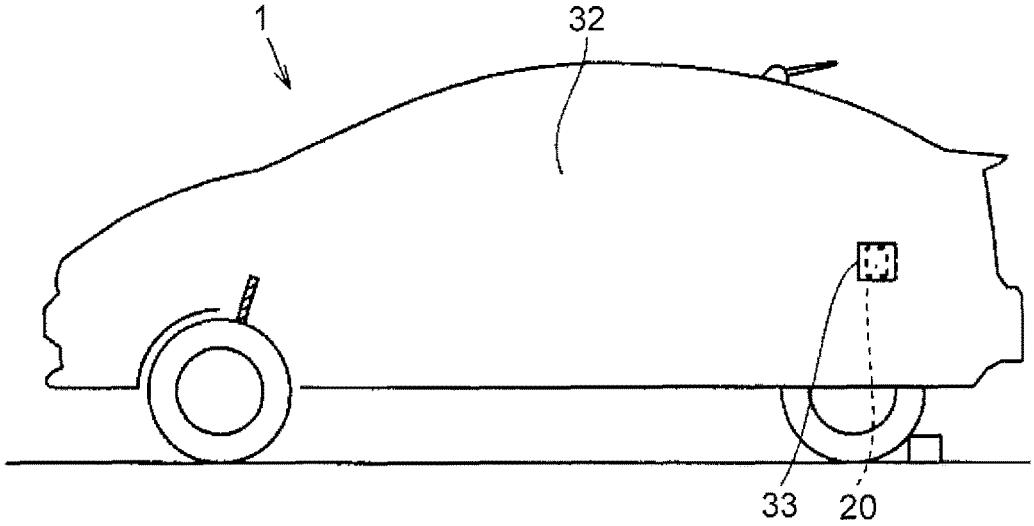
FIG. 2 is a side view of the vehicle 1.

FIG. 2 is a side view of the vehicle 1. As illustrated in FIG. 2, a cover 33 is provided on a side face 32 of the vehicle 1, and when the cover 33 is opened, the charging connector connecting device 20 is accessible from outside of the vehicle.

Figure 3:
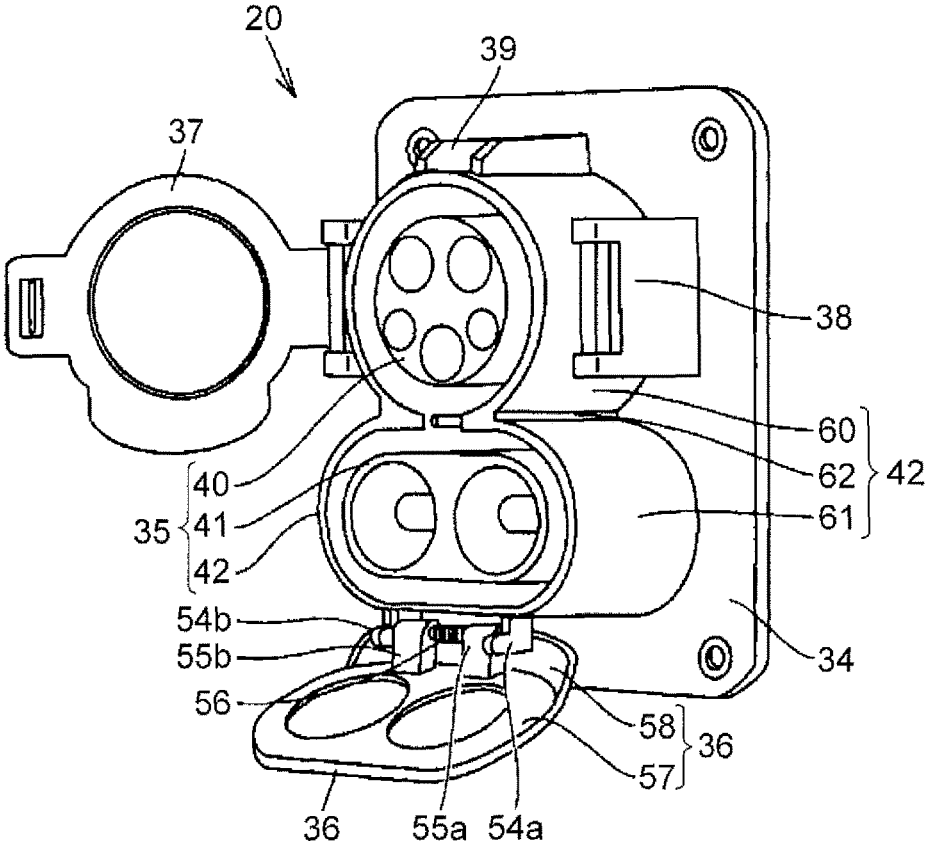
FIG. 3 is a perspective view illustrating a charging connector connecting device 20.

FIG. 3 is a perspective view illustrating the charging connector connecting device 20. The charging connector connecting device 20 includes a substrate 34, a connector connecting portion 35 provided so as to project from a front face of the substrate 34, a cover 36, a cover 37, a stopper 38 that locks the cover 37, a stopper 39, and an elastic member 56.

The connector connecting portion 35 includes a connecting portion 40 having a plurality of terminal holes, a connecting portion 41 provided below the connecting portion 40 and having a plurality of terminal holes, and a guide wall 42 provided so as to surround the connecting portion 40 and the connecting portion 41. The stopper 39 is provided in an upper end of the guide wall 42.

Figure 4:
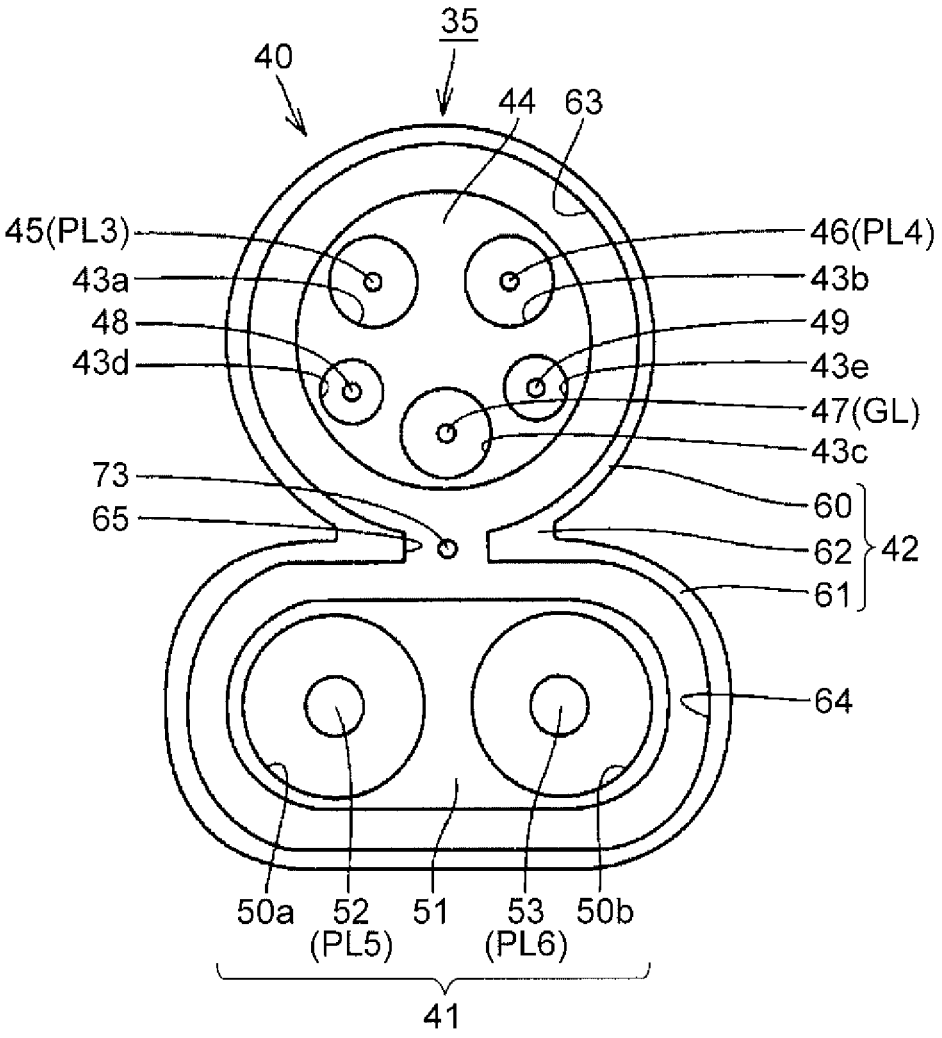
FIG. 4 is a front view illustrating a connector connecting portion 35.

FIG. 4 is a front view illustrating the connector connecting portion 35. The connecting portion 40 includes a columnar body portion 44 having a plurality of terminal holes 43*a* to 43*e*, a power terminal 45 provided in the terminal hole 43*a*, a power terminal 46 provided in the terminal hole 43*b*, a ground terminal 47 provided in the terminal hole 43*c*, a signal terminal 48 provided in the terminal hole 43*d*, and a signal terminal 49 provided in the terminal hole 43*e*. Note that the power terminal 45 is connected to the power line PL3, and the power terminal 46 is connected to the power line PL4.

The connecting portion 41 is provided below the connecting portion 40. The connecting portion 41 includes a columnar body portion 51 having a plurality of terminal holes 50*a*, 50*b*, a power terminal 52 provided in the terminal hole 50*a*, and a power terminal 53 provided in the terminal hole 50*b*. Note that the power terminal 52 is connected to the power line PL5, and the power terminal 53 is connected to the power line PL6.

The guide wall 42 includes a wall 60 provided so as to surround the body portion 44 with a space therebetween, a wall 61 provided so as to surround the body portion 51 with a space therebetween, and a coupling portion 62 that couples the wall 60 with the wall 61.

A groove 63 is formed between the wall 60 and the body portion 44, and a groove 64 is formed between the wall 61 and the body portion 51. The groove 63 and the groove 64 are connected to each other via a coupling groove 65 formed in the coupling portion 62.

In FIG. 3, the cover 36 is provided on a lower end side of the connecting portion 41 and rotatably attached to a lower end of the wall 61. Note that, in a state illustrated in FIG. 3, the cover 36 is positioned at an open position at which the after-mentioned DC charging connector 30 can be connected to the connecting portion 41.

The cover 36 includes a cover main body 57, and a bent portion 58 formed in an end portion of the cover main body 57 so as to be bent with respect to the cover main body 57. The cover main body 57 is provided with projecting portions 55*a*, 55*b*, and the projecting portions 55*a*, 55*b* are rotatably attached to support portions 54*a*, 54*b* formed in a lower end of the wall 61.

The cover main body 57 of the cover 36 can rotate around the support portions 54*a*, 54*b* so as to close the connecting portion 41. More specifically, the cover main body 57 of the cover 36 can close an opening of the wall 61, so as to prevent the DC charging connector 30 from being connected to the connecting portion 41.

The elastic member 56 applies a biasing force to the cover 36 so that a posture of the cover 36 is maintained at a predetermined posture. Note that the posture of the cover 36 is described later in detail.

Figure 5:
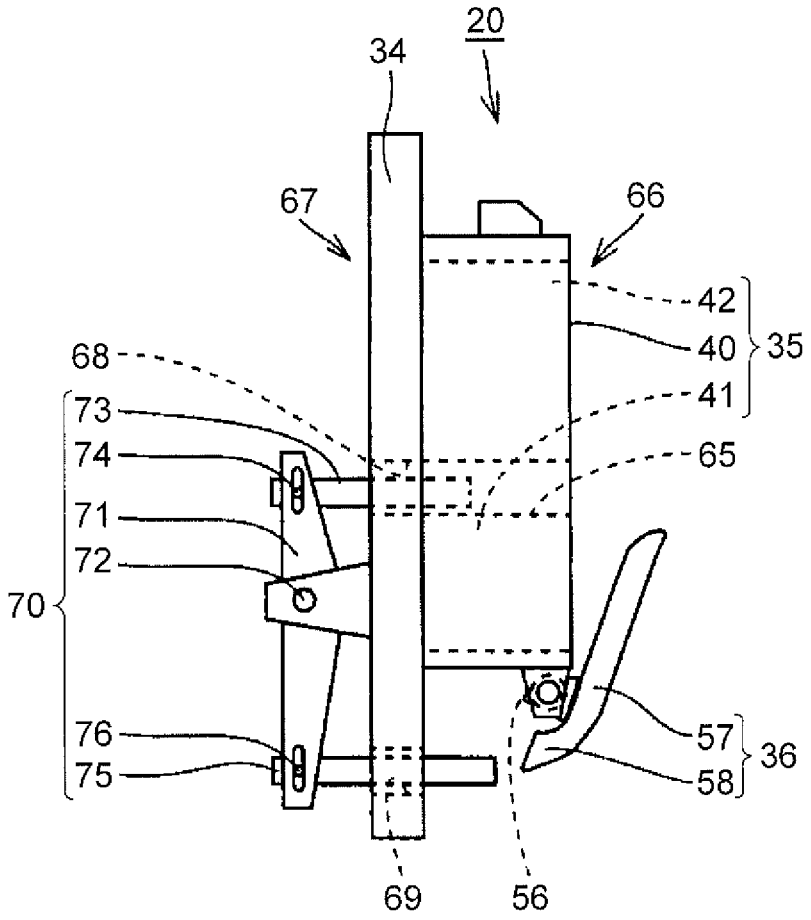
FIG. 5 is a side view of a connecting portion 40 without a cover 37.

FIG. 5 is a side view of the connecting portion 40 without the cover 37 and so on. As illustrated in FIG. 5, the DC charging connector 30 or the AC charging connector 31 is inserted into the charging connector connecting device 20 from a front-face-66 side of the connector connecting portion 35.

The substrate 34 has a through hole 68 that extends to a front face from a back face, and a through hole 69 placed below the connector connecting portion 35. The through hole 68 communicates with the coupling groove 65.

The charging connector connecting device 20 includes a cover pressing mechanism 70 provided on a back-face-67 side of the connector connecting portion 35. The cover pressing mechanism 70 includes an arm portion 71 provided on the back-face-67 side, a support member 72 that supports the arm portion 71 in a swinging manner, an ejection pin 73 provided on an upper end side of the arm portion 71, a hinge 74 that attaches the ejection pin 73 to the arm portion 71 in a rotatable manner, a pressing member 75 provided in a lower end of the arm portion 71, and a hinge 76 that supports the pressing member 75 with respect to the arm portion 71 in a rotatable manner. Note that the pressing member 75 is placed on an opposite side of the support member 72 relative to the ejection pin 73.

The ejection pin 73 enters the coupling groove 65 via the through hole 68. The pressing member 75 penetrates through the substrate 34 via the through hole 69.

Figure 6:
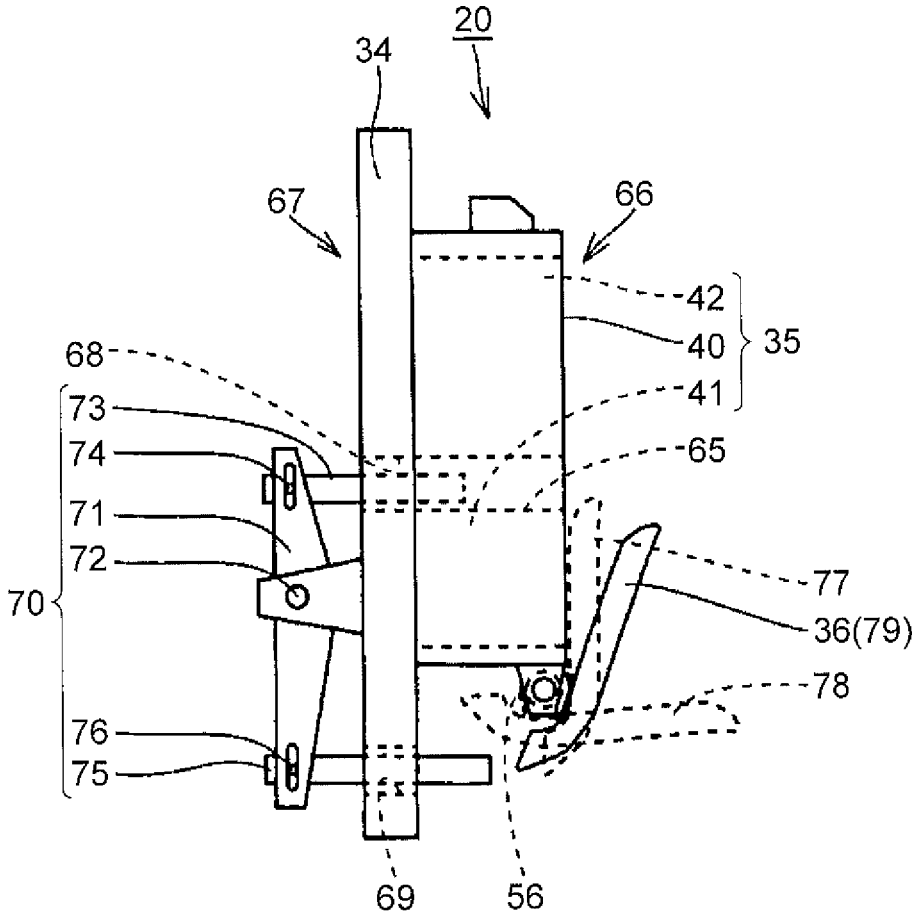
FIG. 6 is a side view illustrating an opened/closed state of a cover 36.

FIG. 6 is a side view illustrating an opened/closed state of the cover 36. In FIG. 6, a reference numeral "77" indicates a closed position at which the cover 36 closes the connecting portion 41. A reference numeral "78" indicates an open position at which the cover 36 opens the connecting portion 41 to the outside. A reference numeral "79" indicates an initial position at which the cover 36 is positioned at the time when no external force, except a biasing force from the elastic member 56, is applied to the cover 36.

Thus, the cover 36 is provided movably between the closed position 77 and the open position 78, and the initial position 79 of the cover 36 is positioned between the closed position 77 and the open position 78. Note that, in an example illustrated in FIG. 6, the initial position 79 is a position closer to the closed position 77 than to the open position 78. Since the cover 36 is supported on the lower end side of the connecting portion 41, when the cover 36 is positioned at the initial position 79, an upper end side of the cover 36 is distanced (spaced) from the connecting portion 41. Note that, at the time when no external force, except a biasing force from the elastic member 56, is applied to the cover 36, the elastic member 56 applies the biasing force to the cover 36 so that the cover 36 is positioned at the initial position 79.

Figure 7:
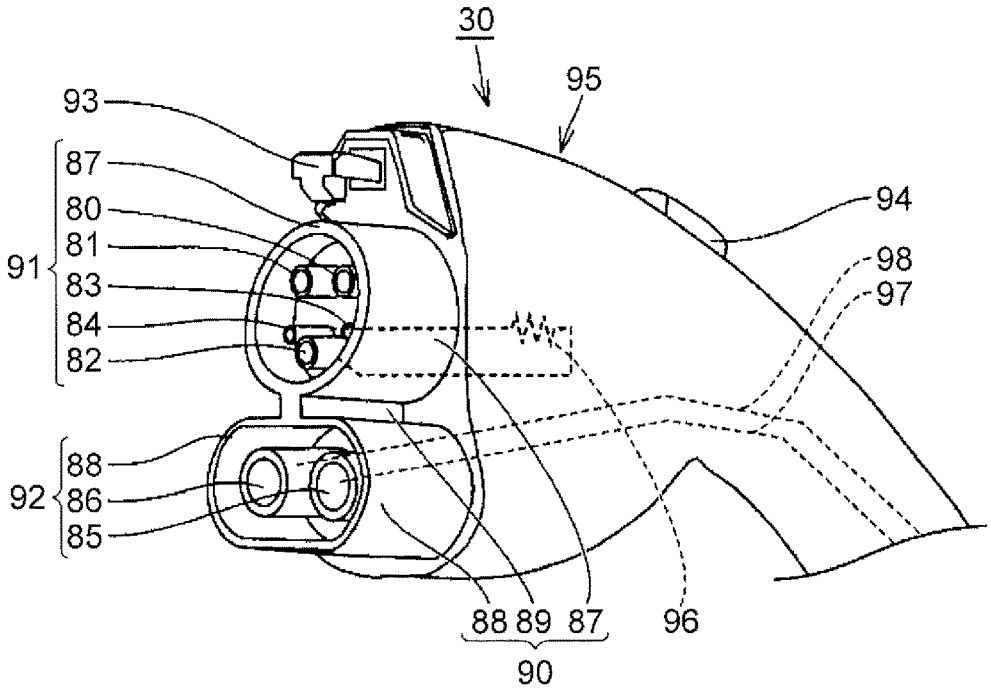
FIG. 7 is a perspective view illustrating a DC charging connector 30.

FIG. 7 is a perspective view illustrating the DC charging connector 30. As illustrated in FIG. 7, the DC charging connector 30 includes a connector case 95, a guide wall 90 provided in a tip end of the connector case 95, a connecting portion 91, a connecting portion 92, a claw portion 93, an operating portion 94 provided on a top face of the connector case 95, and a resistor 96 provided inside the connector case 95.

The operating portion 94 is a member operated by a user. When the operating portion 94 is pushed by the user, for example, the claw portion 93 moves up, so that the claw portion 93 can be hooked on the stopper 39 illustrated in FIG. 3.

The guide wall 90 includes a tubular portion 87 that surrounds a plurality of terminals, a tubular portion 88 that surrounds a plurality of terminals, and a coupling portion 89 that couples the tubular portion 87 with the tubular portion 88. The connecting portion 91 includes the tubular portion 87 that is opened forward, and a terminal 80, a terminal 81, an earth terminal 82, a signal terminal 83, and a signal terminal 84 provided inside the tubular portion 87. One end of the resistor 96 is connected to the earth terminal 82, and the other end of the resistor 96 is connected to the signal terminal 84.

The connecting portion 92 includes the tubular portion 88 that is opened forward, and a DC power terminal 85 and a DC power terminal 86 provided inside the tubular portion 88. A power line 97 is connected to the DC power terminal 85, and a power line 98 is connected to the DC power terminal 86. Note that the power lines 97, 98 are connected to a DC power supply.

When the DC charging connector 30 is connected to the connector connecting portion 35 illustrated in FIGS. 3 and 4, the connecting portion 91 is connected to the connecting portion 40, and the connecting portion 92 is connected to the connecting portion 41.

When the connecting portion 91 is connected to the connecting portion 40, the terminal 80 is connected to the power terminal 45 and the terminal 81 is connected to the power terminal 46. The earth terminal 82 is connected to the ground terminal 47. The signal terminal 83 is connected to the signal terminal 48, and the signal terminal 84 is connected to the signal terminal 49.

When the signal terminal 84 is connected to the signal terminal 49 and the earth terminal 82 is connected to the ground terminal 47, one end of the resistor 96 is connected to the ground line GL, and the other end of the resistor 96 is connected to the signal line SL in FIG. 1.

In FIG. 7, when the connecting portion 92 is connected to the connecting portion 41 illustrated in FIG. 4, the DC power terminal 85 is connected to the power terminal 52, and the DC power terminal 86 is connected to the power terminal 53. Hereby, in FIG. 1, the power line 97 is connected to the power line PL5, and the power line 98 is connected to the power line PL6.

Further, when the DC charging connector 30 illustrated in FIG. 7 is connected to the connector connecting portion 35 illustrated in FIG. 4, the tubular portion 87 enters the groove 63, and the tubular portion 88 enters the groove 64. Then, the coupling portion 89 enters the coupling groove 65. When the coupling portion 89 enters the coupling groove 65, the ejection pin 73 positioned inside the coupling groove 65 is pressed by the coupling portion 89.

Figure 8:
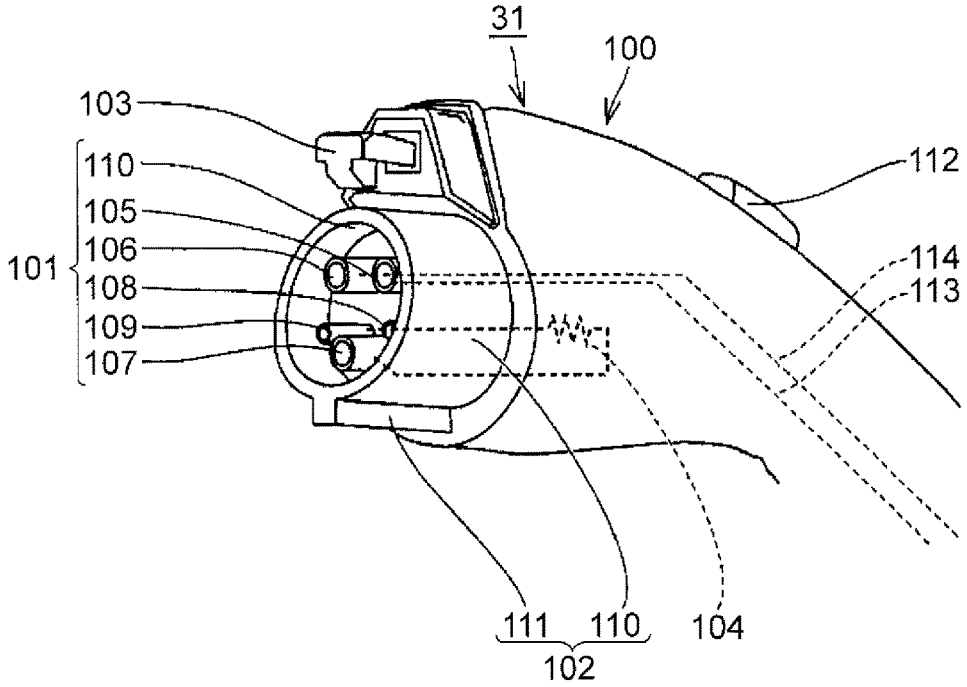
FIG. 8 is a perspective view illustrating an AC charging connector 31.

FIG. 8 is a perspective view illustrating the AC charging connector 31. As illustrated in FIG. 8, the charging connector 31 includes a case main body 100, a connecting portion 101 provided on a tip end surface of the case main body 100, a guide wall 102, a claw portion 103, an operating portion 112 provided on a top face of the case main body 100, and a resistor 104 provided in the case main body 100.

The guide wall 102 includes a tubular portion 110 that surrounds a plurality of terminals and is opened forward, and a protruding portion 111 provided in a lower end of the tubular portion 110.

The connecting portion 101 includes the tubular portion 110, an AC power terminal 105, an AC power terminal 106, an earth terminal 107, a signal terminal 108, and a signal terminal 109 provided inside the tubular portion 110.

One end of the resistor 104 is connected to the earth terminal 107, and the other end of the resistor 104 is connected to the signal terminal 109. A power line 113 is connected to the AC power terminal 105, and a power line 114 is connected to the AC power terminal 106.

When the AC charging connector 31 is connected to the connecting portion 40 illustrated in FIGS. 3 and 4, the AC power terminal 105 is connected to the power terminal 45, and the AC power terminal 106 is connected to the power terminal 46. The earth terminal 107 is connected to the ground terminal 47. The signal terminal 108 is connected to the signal terminal 48, and the signal terminal 109 is connected to the signal terminal 49.

When the earth terminal 107 is connected to the ground terminal 47 and the signal terminal 109 is connected to the signal terminal 49, one end of the resistor 104 is connected to the signal line SL and the other end of the resistor 104 is connected to the ground line GL in FIG. 1.

When the AC power terminal 105 is connected to the power terminal 45 and the AC power terminal 106 is connected to the power terminal 46, the power line 113 is connected to the power line PL3, and the power line 114 is connected to the power line PL4.

Further, when the connecting portion 101 is connected to the connecting portion 40, the tubular portion 110 is inserted into the groove 63, and the protruding portion 111 is inserted into the coupling groove 65. Hereby, the ejection pin 73 positioned inside the coupling groove 65 is pressed by the protruding portion 111.

Note that the AC charging connector 31 does not include a member to be connected to the connecting portion 41 illustrated in FIGS. 4 and 3.

When the AC charging connector 31 is connected to the charging connector connecting device 20, the connecting portion 41 is exposed outside. If both electrodes of the DC charging relay 23 are welded (fused in the closed state), a voltage is applied to the power terminal 52 and the power terminal 53.

In view of this, in the vehicle 1 (the charging connector connecting device 20) according to the present embodiment, in a case where the AC charging connector 31 is connected to the charging connector connecting device 20, the connecting portion 41 is closed by the cover 36. Further, even if an external force is applied to the cover 36 by an erroneous operation of the user in a state where the cover 36 is closed, the cover 36 is restrained from being opened. Further, when the DC charging connector 30 is connected to the charging connector connecting device 20, the cover 36 can be positioned at the open position, so that the DC charging connector 30 can be connected well.

Next will be described operations and effects of the charging connector connecting device 20 in detail with reference to FIG. 9 and so on.

Figure 9:
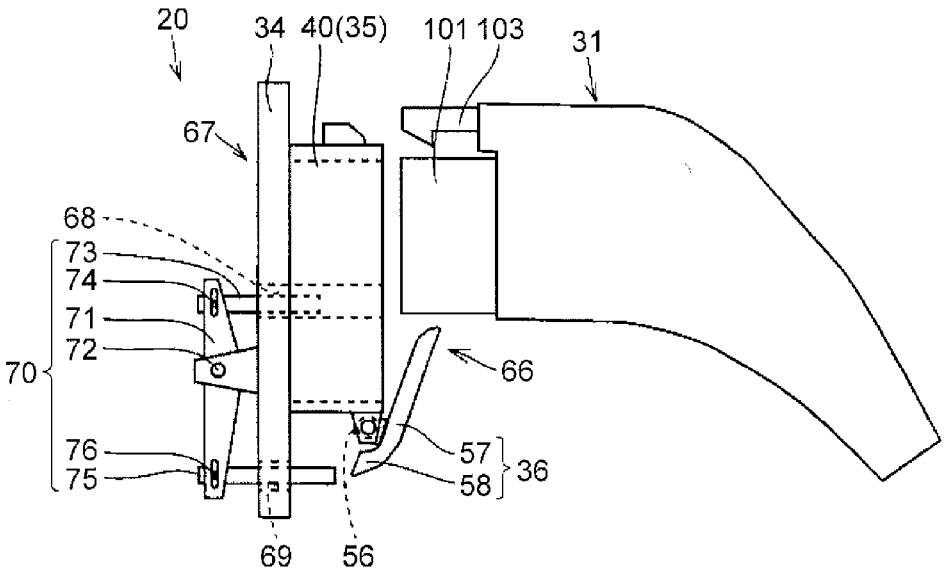
FIG. 9 is a side view illustrating a state before the AC charging connector 31 is inserted into the charging connector connecting device 20.
Figure 10:
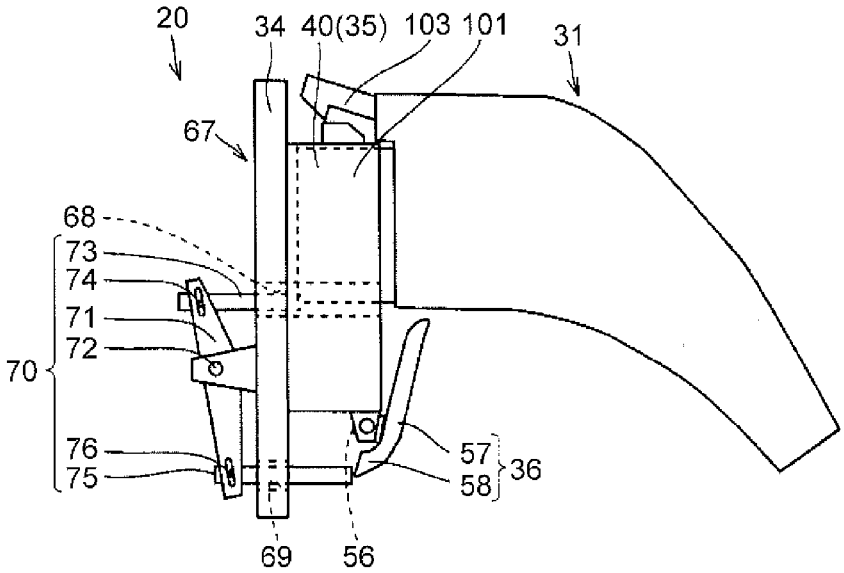
FIG. 10 is a side view illustrating a state where the AC charging connector 31 is started to be inserted into the charging connector connecting device 20.
Figure 11:
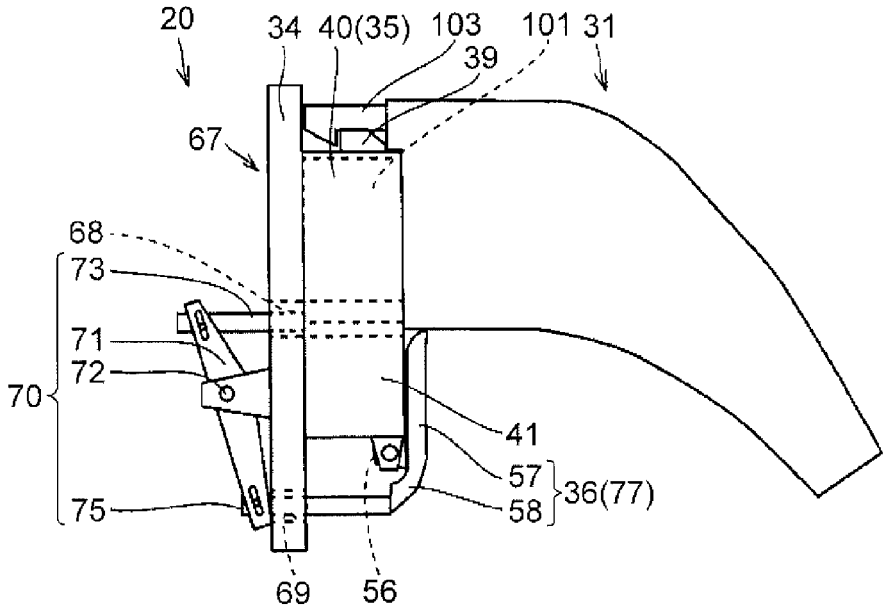
FIG. 11 is a side view illustrating a state where the insertion of the AC charging connector 31 into the charging connector connecting device 20 is completed.

FIGS. 9 to 11 illustrate an operation procedure at the time when the AC charging connector 31 is connected to the charging connector connecting device 20. In a state illustrated in FIG. 9, the cover 37 illustrated in FIG. 3 is opened, and the connecting portion 101 of the AC charging connector 31 is distanced from the connecting portion 40.

Accordingly, the ejection pin 73 is not pressed by the connecting portion 101, and no external force, except the biasing force from elastic member 56, is applied to the cover 36.

Subsequently, as illustrated in FIG. 10, when the connecting portion 101 is partially inserted into the connector connecting portion 35, the connecting portion 101 starts to press the ejection pin 73. Along with the insertion of the connecting portion 101, the ejection pin 73 moves in a direction toward the back-face-67 side from the front-face-66 side.

When the ejection pin 73 moves as described above, the arm portion 71 rotates around the support member 72. When the arm portion 71 rotates, the upper end of the arm portion 71 is separated from the substrate 34, and the lower end of the arm portion 71 approaches the substrate 34.

When the lower end of the arm portion 71 approaches the substrate 34, the pressing member 75 attached to the lower end side of the arm portion 71 moves in a direction toward the front-face-66 side from the back-face-67 side of the connector connecting portion 35.

When the pressing member 75 moves as described above, the tip end of the pressing member 75 approaches an end portion of the bent portion 58 of the cover 36.

When an insertion length of the connecting portion 101 reaches a predetermined length, the tip end of the pressing member 75 makes contact with the end portion of the bent portion 58.

When the connecting portion 101 is further inserted, the pressing member 75 presses the cover 36 along with the insertion, so that the cover 36 rotates. Hereby, the cover 36 illustrated in FIG. 10 rotates to the closed position from the initial position 79 illustrated in FIG. 9.

FIG. 11 illustrates a state where the insertion of the AC charging connector 31 into the charging connector connecting device 20 is completed and the AC charging connector 31 is connected to the connecting portion 40. As illustrated in FIG. 11, in a state where the AC charging connector 31 is connected to the connecting portion 40, the claw portion 103 is locked by the stopper 39. In a state where the AC charging connector 31 is connected to the connecting portion 40 as such, even if an external force is applied to the AC charging connector 31, the AC charging connector 31 is restrained from being removed from the connecting portion 40. In a state where the AC charging connector 31 is connected to the connecting portion 40, the cover 36 is positioned at the closed position 77, so that the connecting portion 41 is closed by the cover 36.

Here, in the state illustrated in FIG. 11, the cover 36 is pressed by the pressing member 75, and the pressing member 75 is supported by the AC charging connector 31 through the arm portion 71 and the ejection pin 73. On this account, as long as the AC charging connector 31 is connected to the connecting portion 40, even if an external force is applied to the cover 36, the cover 36 is restrained from being opened.

Particularly, in an example illustrated in FIG. 11, in a state where the insertion of the connecting portion 101 is completed, the claw portion 103 engages with the stopper 39. On this account, even if an external force is applied to the cover 36 in the state illustrated in FIG. 11, the connecting portion 101 is restrained from moving, thereby making it possible to restrain the cover 36 from being opened.

Hereby, in a course where the user connects the AC charging connector 31 to the charging connector connecting device 20, the cover 36 closes the connecting portion 41, thereby making it possible to restrain a hand or the like of the user from touching the connecting portion 41.

Here, in FIG. 1, when the AC charging connector 31 is connected to the charging connector connecting device 20, the resistor 104 is connected to the signal line SL and the ground line GL. A predetermined voltage is applied to the pull-up power supply 25, and when the resistor 104 is connected as such, a voltage detected by the voltage sensor 24 fluctuates.

Further, a resistance value of the resistor 104 is different from a resistance value of the resistor 96, and a voltage value detected by the voltage sensor 24 at the time when the DC charging connector 30 is connected is different from a voltage value detected by the voltage sensor 24 at the time when the AC charging connector 31 is connected. Hereby, the ECU 4 can detect whether the DC charging connector 30 is connected to the charging connector connecting device 20 or the AC charging connector 31 is connected thereto.

The ECU 4 performs welding check on the AC charging relay 22 in a state where the AC charging connector 31 is connected to the charging connector connecting device 20.

At this time, if both electrodes of the DC charging relay 23 are welded, a voltage from the battery 9 is applied to the power terminals 52, 53 illustrated in FIG. 4. However, as illustrated in FIG. 11, the cover 36 closes the connecting portion 41, so that the power terminals 52, 53 to which the voltage is being applied are restrained from being exposed outside.

Next will be described a case where the DC charging connector 30 is connected to the connector connecting portion 35 with the use of FIG. 12.

Figure 12:
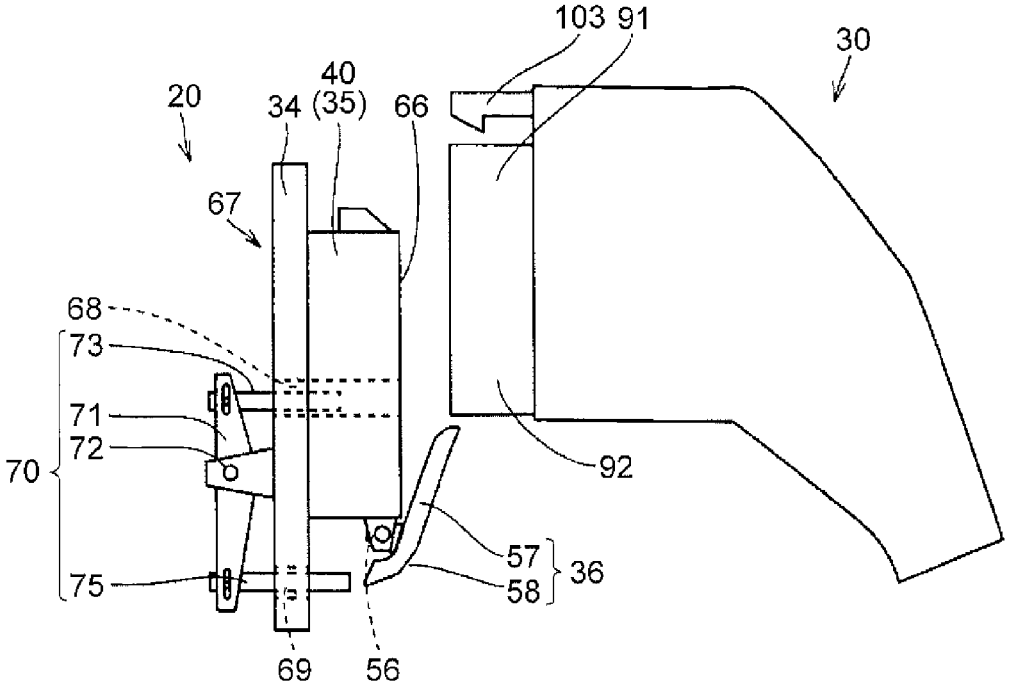
FIG. 12 is a side view illustrating a state before the DC charging connector 30 is inserted into the charging connector connecting device 20.

In a state illustrated in FIG. 12, the connecting portions 91, 92 of the DC charging connector 30 are distanced from the connector connecting portion 35. Accordingly, the cover 36 is positioned at the initial position 79. Because of this, the upper end of the cover 36 is distanced from the front face 66 of the connector connecting portion 35.

Figure 13:
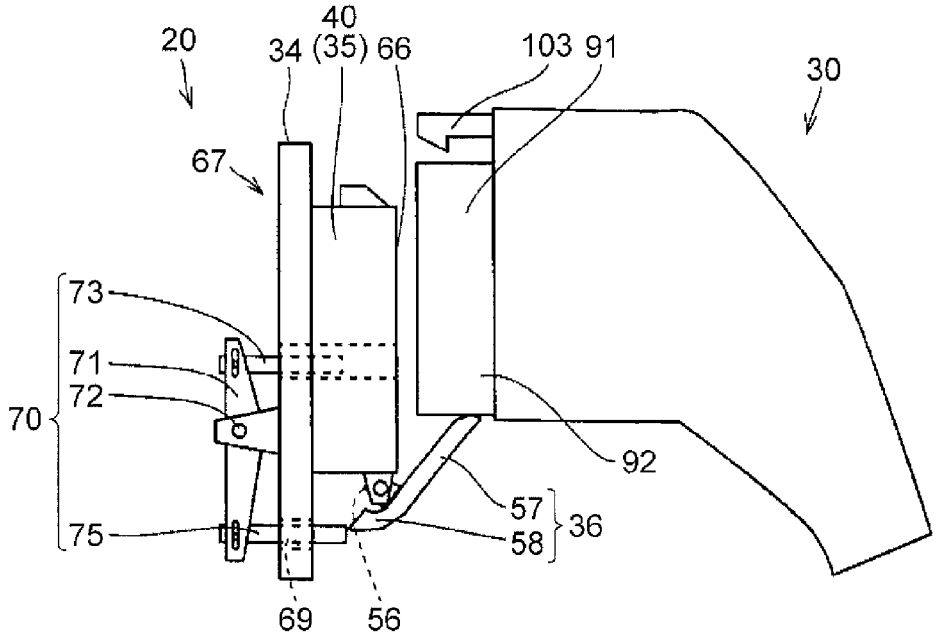
FIG. 13 is a side view illustrating a state where a cover 36 is started to be opened by the DC charging connector 30.

In the consideration of FIG. 13, the user presses the cover 36 downward with the DC charging connector 30. Since the cover 36 is pressed by the DC charging connector 30, the cover 36 slightly rotates toward the open position 78 from the initial position 79.

Figure 14:
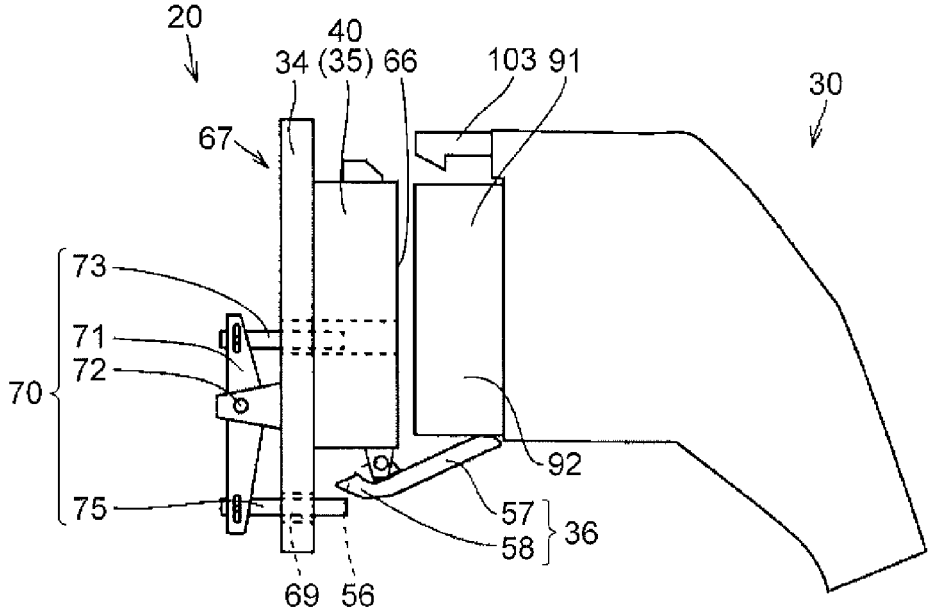
FIG. 14 is a side view illustrating a state where the cover 36 is opened by the DC charging connector 30.

In the consideration of FIG. 14, the user further moves the DC charging connector 30 downward from the state illustrated in FIG. 13, so that the cover 36 rotates toward the open position 78.

Figure 15:
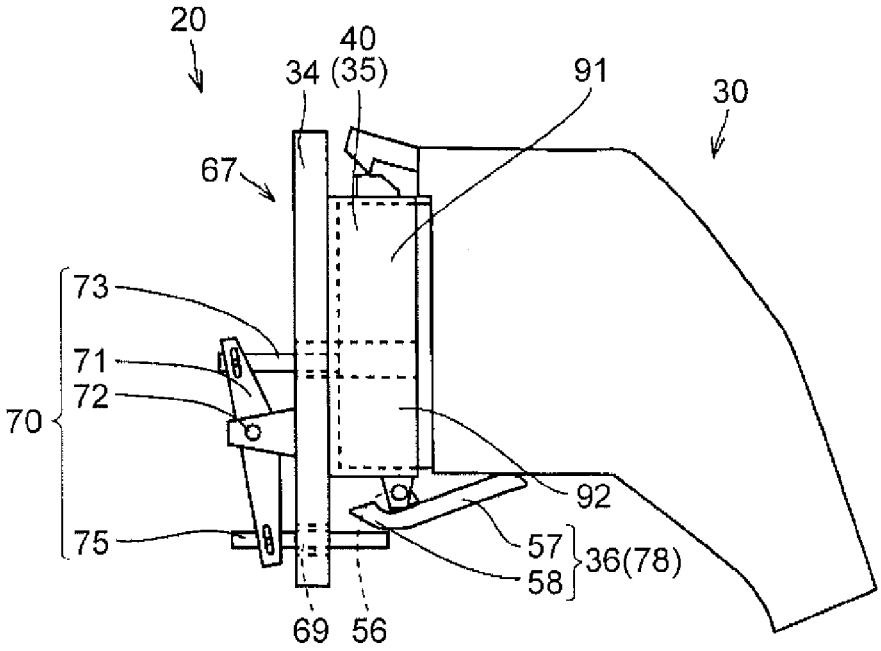
FIG. 15 is a side view illustrating a state where the DC charging connector 30 is started to be inserted into the connecting portion 40.

In the consideration of FIG. 15, the cover 36 is positioned at the open position 78. Then, the user inserts the connecting portion 91 into the connecting portion 40 and inserts the connecting portion 92 into the connecting portion 41. Hereby, the ejection pin 73 moves toward the back-face-67 side from the front-face-66 side.

When the ejection pin 73 moves as described above, the arm portion 71 rotates. The upper end of the arm portion 71 moves so as to be separated from the substrate 34, and the lower end of the arm portion 71 moves so as to approach the substrate 34. Hereby, the pressing member 75 moves in a direction toward the front-face-66 side from the back-face-67 side.

Here, the cover 36 positioned at the open position 78 and the pressing member 75 that has moved to the front-face-66 side are distanced from each other. That is, even if the DC charging connector 30 is connected to the connecting portion 40 and the connecting portion 41, since the cover 36 is positioned at the open position 78 in advance, the cover 36 is never pressed by the pressing member 75. As a result, even if the DC charging connector 30 is connected to the connector connecting portion 35, such a situation is restrained that the cover 36 rotates toward the closed position 77 and the cover 36 and the DC charging connector 30 interfere with each other.

Figure 16:
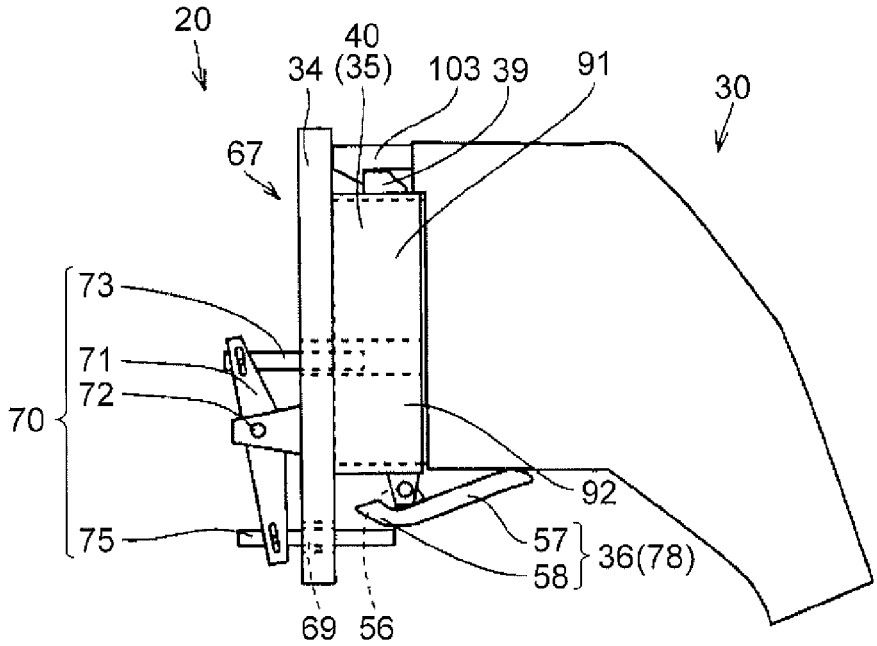
FIG. 16 is a side view illustrating a state where the insertion of the DC charging connector 30 into the connecting portion 40 is completed.

As illustrated in FIG. 16, the connecting portion 91 is connected to the connecting portion 40, and the connecting portion 92 is connected to the connecting portion 41. Here, in a state where the DC charging connector 30 is connected to the connecting portion 40 and the connecting portion 41, the claw portion 103 is locked by the stopper 39. In a state where the DC charging connector 30 is connected to the connecting portion 40 as such, even if an external force is applied to the DC charging connector 30, the DC charging connector 30 is restrained from being removed from the connecting portion 40.

In FIG. 1, when the DC charging connector 30 is connected to the charging connector connecting device 20, the resistor 96 is connected to the signal line SL and the ground line GL. When the resistor 96 is connected, a voltage of the signal line SL changes, so that the voltage sensor 24 detects the voltage of the signal line SL after the resistor 96 is connected. The ECU 4 detects, based on a voltage value detected by the voltage sensor 24, that the DC charging connector 30 is connected to the charging connector connecting device 20.

When it is determined that the DC charging connector 30 is connected, the ECU 4 turns on the DC charging relay 23. After that, a direct-current power is supplied from the DC charging connector 30, and an electric power is supplied to the battery 9.

For example, after charging is completed, the ECU 4 performs welding check on the DC charging relay 23 in a state where the DC charging connector 30 is connected. At this time, the connecting portion 40 of the charging connector connecting device 20 is closed by the connecting portion 91 of the DC charging connector 30 and the connecting portion 41 is closed by the connecting portion 92. Thus, the connecting portions 40, 41 are restrained from being exposed outside during the welding check.

Figure 17:
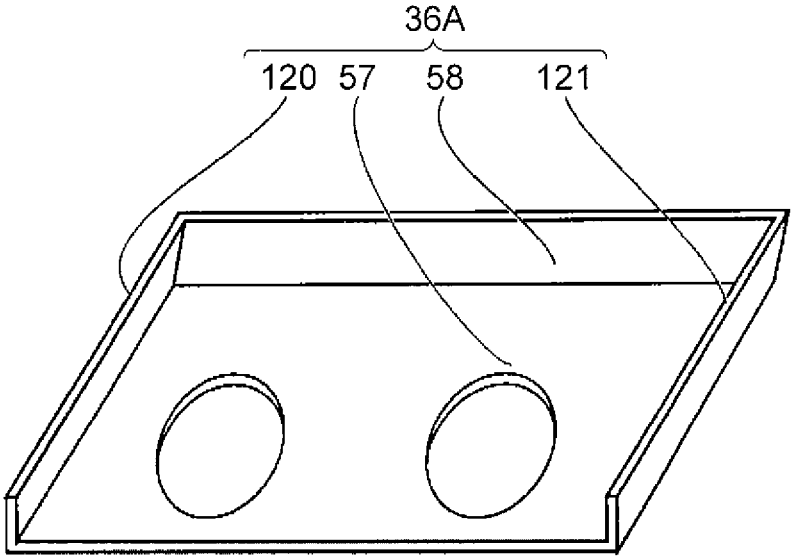
FIG. 17 is a perspective view illustrating a modification of the cover 36 that closes a connecting portion 41 of a connector connecting portion 35.

FIG. 17 is a perspective view illustrating a modification of the cover 36A that closes the connecting portion 41 of the connector connecting portion 35. As illustrated in FIG. 17, the cover 36A includes a cover main body 57, a bent portion 58, and support walls 120, 121.

The support wall 120 is formed in one lateral side portion of the cover main body 57, and the support wall 121 is formed in the other lateral side portion of the cover main body 57. As illustrated in FIGS. 14 to 16, at the time when the DC charging connector 30 is placed on the cover 36, the support wall 120 and the support wall 121 support side faces of the DC charging connector 30. This makes it easy to perform positioning at the time when the DC charging connector 30 is inserted into the connector connecting portion 35.

Figure 18:
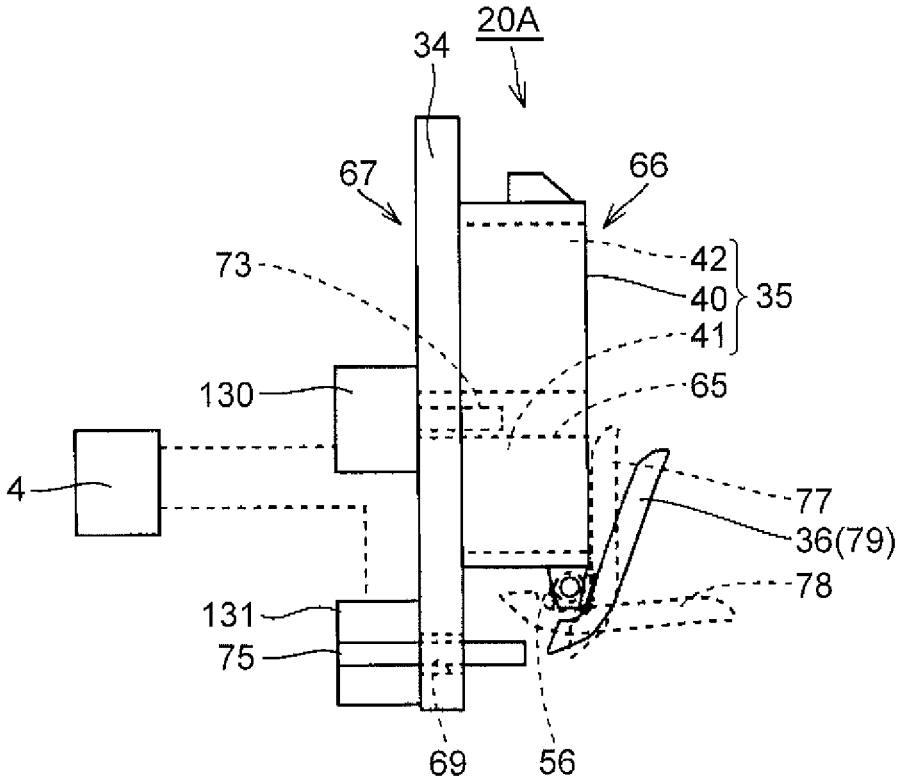
FIG. 18 is a side view schematically illustrating a modification of the connector connecting portion 35.

FIG. 18 is a side view schematically illustrating a modification of the connector connecting portion 35. Note that, in FIG. 18, the same constituents as illustrated in FIG. 5 have the same reference numerals as in FIG. 5, and their description may be omitted.

A charging connector connecting device 20A illustrated in FIG. 18 includes an ejection pin 73 provided inside a coupling groove 65, a detector 130 that detects a movement of the ejection pin 73 while permitting the movement of the ejection pin 73, and an actuator 131 that moves a pressing member 75.

The detector 130 and the actuator 131 are placed on a back-face-67 side of a connector connecting portion 35.

In the charging connector connecting device 20A, when the DC charging connector 30 or the AC charging connector 31 is inserted into the connector connecting portion 35, the ejection pin 73 moves toward the back-face-67 side from a front-face-66 side. The detector 130 detects a movement of the ejection pin 73. When the movement of the ejection pin 73 is detected, an ECU 4 drives the actuator 131.

The actuator 131 moves the pressing member 75 so that the pressing member 75 moves toward the front-face-66 side from the back-face-67 side. At this time, in a case where the AC charging connector 31 is connected to the connector connecting portion 35, the pressing member 75 presses a cover 36 so that the cover 36 moves to a closed position.

Even in the charging connector connecting device 20A, the actuator 131 supports the pressing member 75, and the cover 36 is supported by the pressing member 75. Hereby, even if an external force is applied to the cover 36 positioned at the closed position 77, the cover 36 is restrained from being opened.

In the meantime, in a case where the DC charging connector 30 is connected to the connector connecting portion 35, the cover 36 is positioned at an open position 78. Accordingly, even if the pressing member 75 moves, the pressing member 75 does not make contact with the cover 36.

Note that, according to the connector connecting portion 35, the DC charging connector 30, and the AC charging connector 31 of the above embodiment, the pressing member 75 is configured to move in either of the cases where the DC charging connector 30 is connected to the connector connecting portion 35 and where the AC charging connector 31 is connected thereto. However, such a configuration is not a necessary configuration, and the pressing member 75 may be moved only in a case where the AC charging connector 31 is connected.

Figure 19:
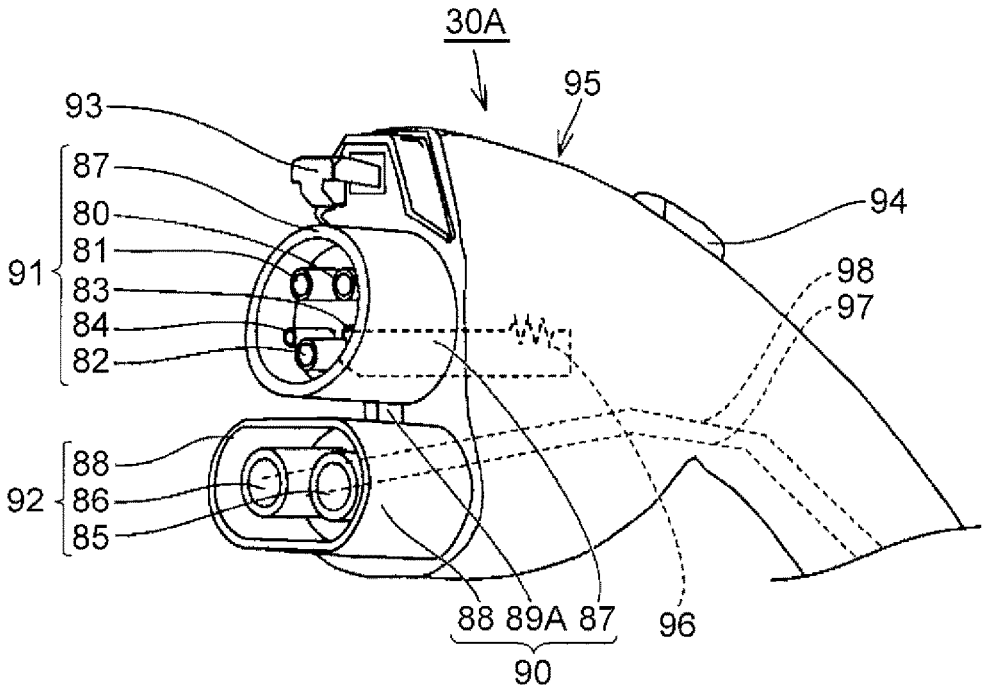
FIG. 19 is a perspective view illustrating a modification of the DC charging connector 30.

For example, in a DC charging connector 30A illustrated in FIG. 19, a length of a coupling portion 89A is formed to be shorter than a length of the protruding portion 111 illustrated in FIG. 8.

When the DC charging connector 30A is connected to the charging connector connecting device 20 illustrated in FIG. 5, the coupling portion 89A does not press the ejection pin 73. Because of this, the pressing member 75 does not move when the DC charging connector 30A is connected. In the meantime, when the AC charging connector 31 is connected to the charging connector connecting device 20, the pressing member 75 moves. Thus, the cover 36 moves to the closed position 77.

As such, the pressing member 75 may be moved only when the AC charging connector 31 is connected to the charging connector connecting device 20.

Embodiment 2

With reference to FIGS. 20 to 27, the following describes a charging connector connecting device 150 according to Embodiment 2.

Figure 20:
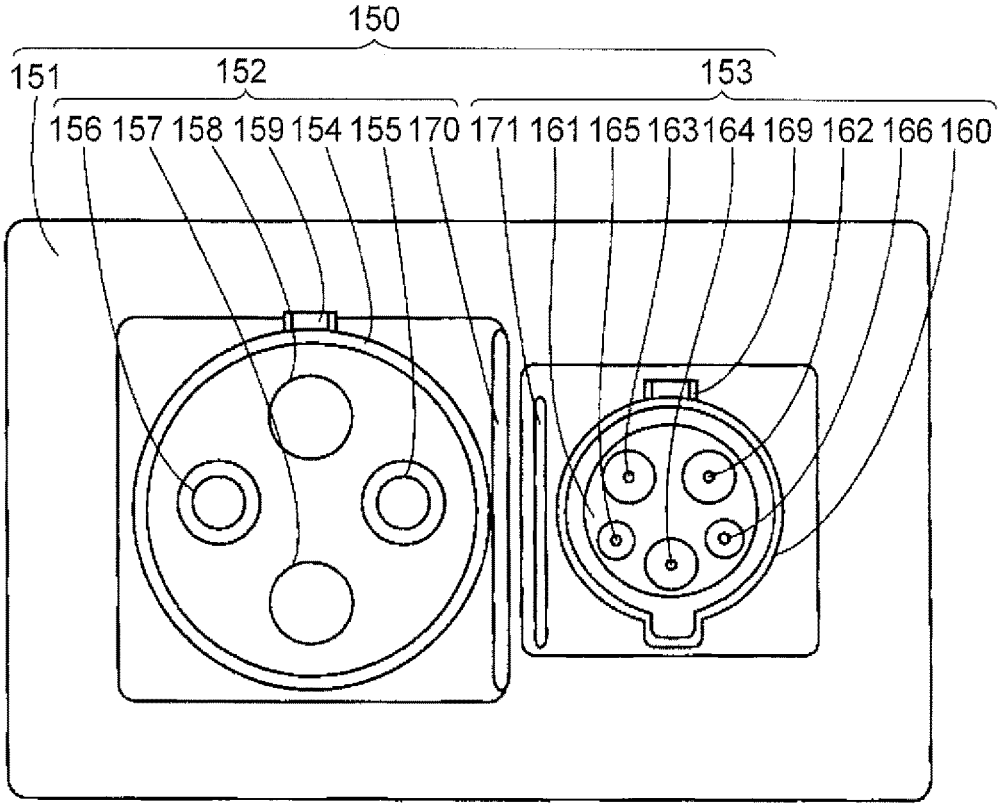
FIG. 20 is a front view illustrating a charging connector connecting device 150.

FIG. 20 is a front view illustrating the charging connector connecting device 150. As illustrated in FIG. 20, the charging connector connecting device 150 includes a substrate 151, a connecting portion 152 provided on a front face of the substrate 151, and a connecting portion 153 provided on the front face of the substrate 151 via a space from the connecting portion 152. A DC charging connector is connected to the connecting portion 152, and an AC charging connector is connected to the connecting portion 153. Note that, in an example illustrated in FIG. 20, a DC charging connector of a CHAdeMO system is connected to the connecting portion 152.

The connecting portion 152 includes: a guide wall 154 formed in a tubular shape; power terminals 155, 156 provided inside the guide wall 154; communication terminals 157, 158 provided inside the guide wall 154; a stopper 159 provided in an upper end of the guide wall 154; and a cover 170 provided on a side face of the guide wall 154 in a rotatable manner.

The connecting portion 153 includes: a guide wall 160 formed in a tubular shape; a body portion 161 placed inside the guide wall 160 and having a plurality of terminal holes; power terminals 162, 163 provided in the terminal holes of the body portion 161; a ground terminal 164 provided in the terminal hole of the body portion 161; signal terminals 165, 166 provided in the terminal holes of the body portion 161; a stopper 169 provided in an upper end of the guide wall 160; and a cover 171 provided on a side face of the guide wall 160 in a rotatable manner.

Figure 21:
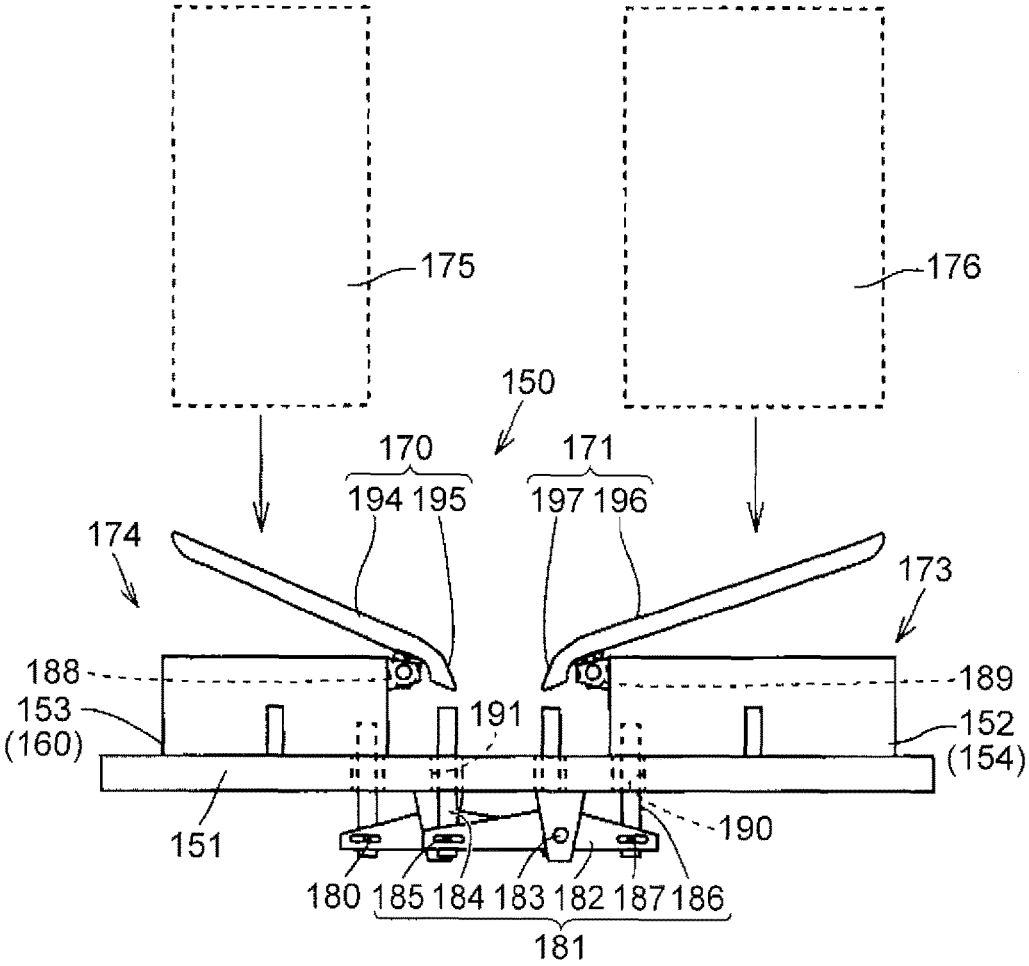
FIG. 21 is a top view of the charging connector connecting device 150 when viewed from above.

FIG. 21 is a top view of the charging connector connecting device 150 when viewed from above. With reference to FIG. 21, a DC charging connector 176 is connected from a front-face-173 side of the connecting portion 152, and an AC charging connector 175 is connected from a front-face-174 side of the connecting portion 153.

The charging connector connecting device 150 includes an elastic member 188 provided in the cover 170, an elastic member 189 provided in the cover 171, a cover pressing mechanism 180 that presses the cover 170 provided in the connecting portion 153, and a cover pressing mechanism 181 that presses the cover 171 provided in the connecting portion 152. The cover pressing mechanism 180 and the cover pressing mechanism 181 are provided on respective back-face sides of the connecting portions 153, 152.

The cover pressing mechanism 180 and the cover pressing mechanism 181 are provided so as to be superimposed on top of each other in an up-down direction, and the cover pressing mechanism 181 is provided above the cover pressing mechanism 180.

The cover pressing mechanism 181 includes: an arm portion 182 provided on a back face side of the substrate 151; a support member 183 attached to the substrate 151 so that the arm portion 182 can swing; an ejection pin 186 provided in one end of the arm portion 182; a hinge 187 that attaches the ejection pin 186 to one end of the arm portion 182; a pressing member 184 provided in the other end of the arm portion 182; and a hinge 185 that attaches the pressing member 184 to the other end of the arm portion 182.

The ejection pin 186 passes through a through hole 190 formed in the substrate 151 so as to project inside the guide wall 154. The pressing member 184 passes through a through hole 191 formed in the substrate 151 so as to project from the front face of the substrate 151.

The cover 170 is provided on the side face of the guide wall 160 in a rotatable manner, and the cover 170 includes a cover main body 194, and a bent portion 195 provided in one end of the cover main body 194 so as to bend from the cover main body 194. The pressing member 184 of the cover pressing mechanism 181 is provided near the bent portion 195.

Figure 22:
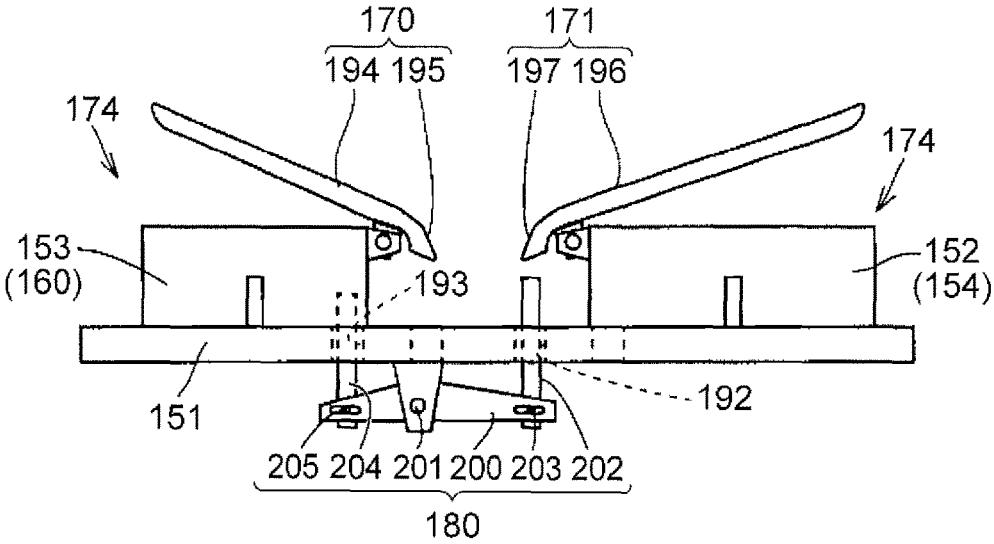
FIG. 22 is a top view of the charging connector connecting device 150 when a cover pressing mechanism 181 is omitted from FIG. 21.

FIG. 22 is a top view of the charging connector connecting device 150 when the cover pressing mechanism 181 is omitted from FIG. 21. As illustrated in FIG. 22, the cover pressing mechanism 180 includes: an arm 200 provided on the back-face side of the substrate 151; a support member 201 attached to the substrate 151 so that the arm 200 can swing; a pressing member 202 provided in one end of the arm 200; a hinge 203 that attaches the pressing member 202 to the one end of the arm 200; an ejection pin 204 provided in the other end of the arm 200; and a hinge 205 that attaches the ejection pin 204 to the other end of the arm 200.

The pressing member 202 is provided so as to pass through a through hole 192 formed in the substrate 151 and project from the front face of the substrate 151. The ejection pin 204 is provided so as to pass through a through hole 193 formed in the substrate 151 and project inside the guide wall 160.

The cover 171 includes a cover main body 196, and a bent portion 197 formed in an end portion of the cover main body 196 so as to bend from the end portion of the cover main body 196.

Figure 23:
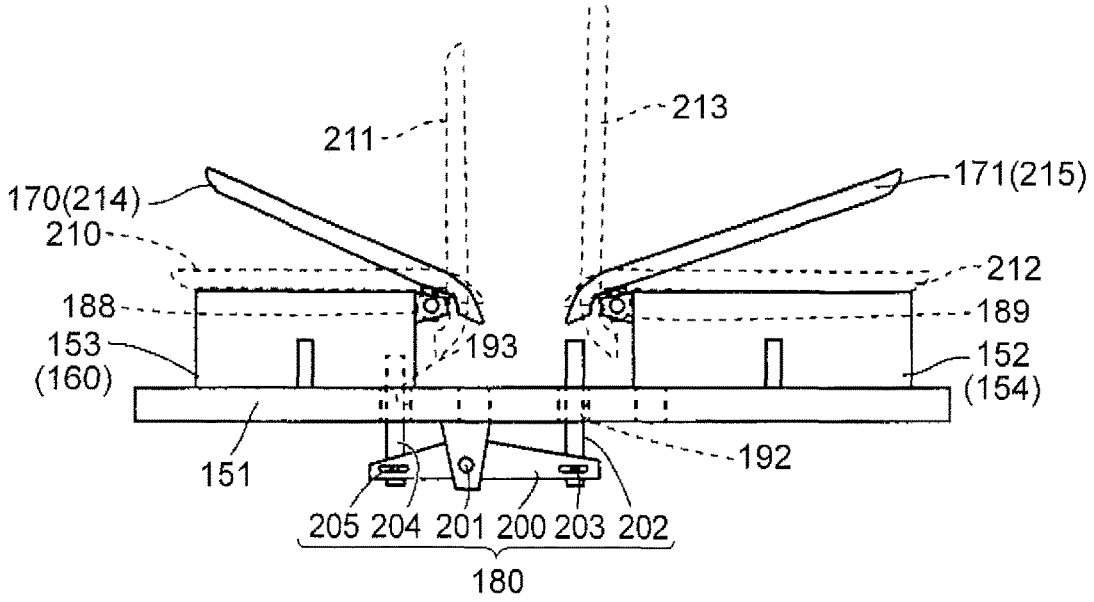
FIG. 23 is a top view illustrating an opened/closed state of each cover.

The pressing member 202 is positioned near the bent portion 197. FIG. 23 is a top view illustrating an opened/closed state of each cover. As illustrated in FIG. 23, the cover 170 is provided on the side face of the guide wall 160 so that the cover 170 is movable between a closed position 210 at which the connecting portion 153 is closed and an open position 211 at which the connecting portion 153 is opened outside. When the cover 170 is positioned at the open position 211, the AC charging connector 175 can be connected to the connecting portion 153. The elastic member 188 applies a biasing force to the cover 170 so that the cover 170 is placed at an initial position 214, and the initial position 214 is placed between the closed position 210 and the open position 211. Note that it is preferable that the initial position 214 be closer to the closed position 210 than to the open position 211 between the closed position 210 and the open position 211.

The cover 171 is provided on the side face of the guide wall 154 so that the cover 171 is movable between a closed position 212 at which the connecting portion 152 is closed and an open position 213 at which the connecting portion 152 is opened outside. When the cover 171 is positioned at the open position 213, the DC charging connector 176 can be connected to the connecting portion 152. The elastic member 189 applies a biasing force to the cover 171 so that the cover 171 is positioned at an initial position 215.

The initial position 215 is positioned between the closed position 212 and the open position 213. Note that it is preferable that the initial position 215 be closer to the closed position 212 than to the open position 213.

The following describes a case where the AC charging connector 175 or the DC charging connector 176 is connected to the charging connector connecting device 150 configured as described above.

Figure 24:
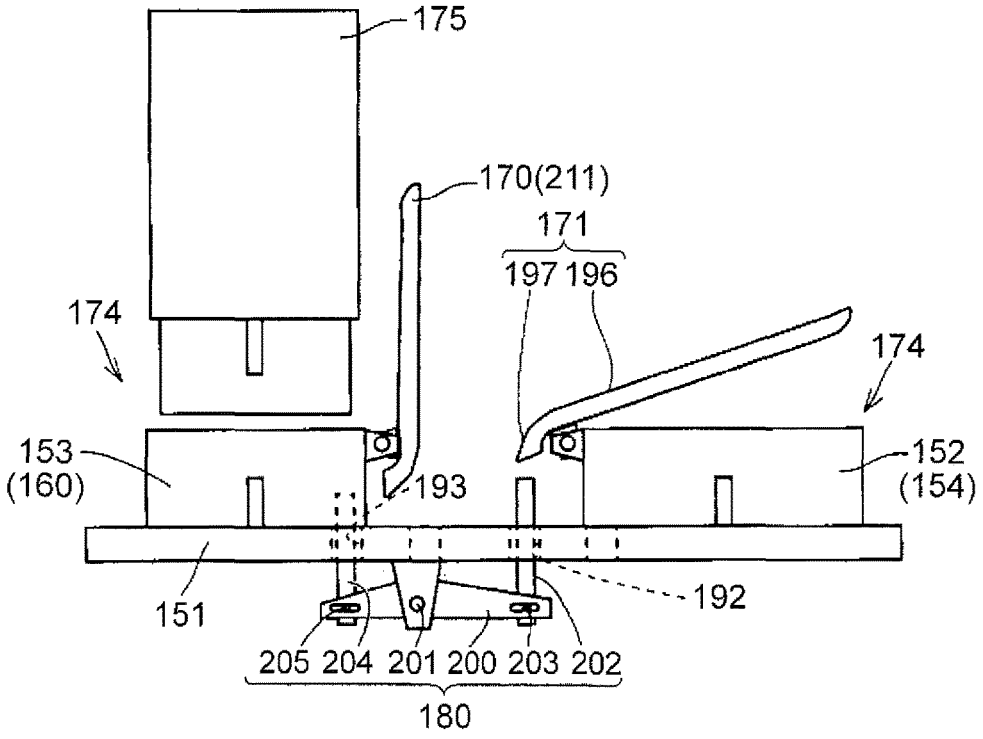
FIG. 24 is a top view illustrating a state where a cover 170 is opened to an open position 211 by an AC charging connector 175.

As illustrated in FIG. 24, at the time when the AC charging connector 175 is connected, the cover 170 positioned at the initial position 214 is first pushed to be opened by the AC charging connector 175. Then, the cover 170 is positioned at the open position 211.

Figure 25:
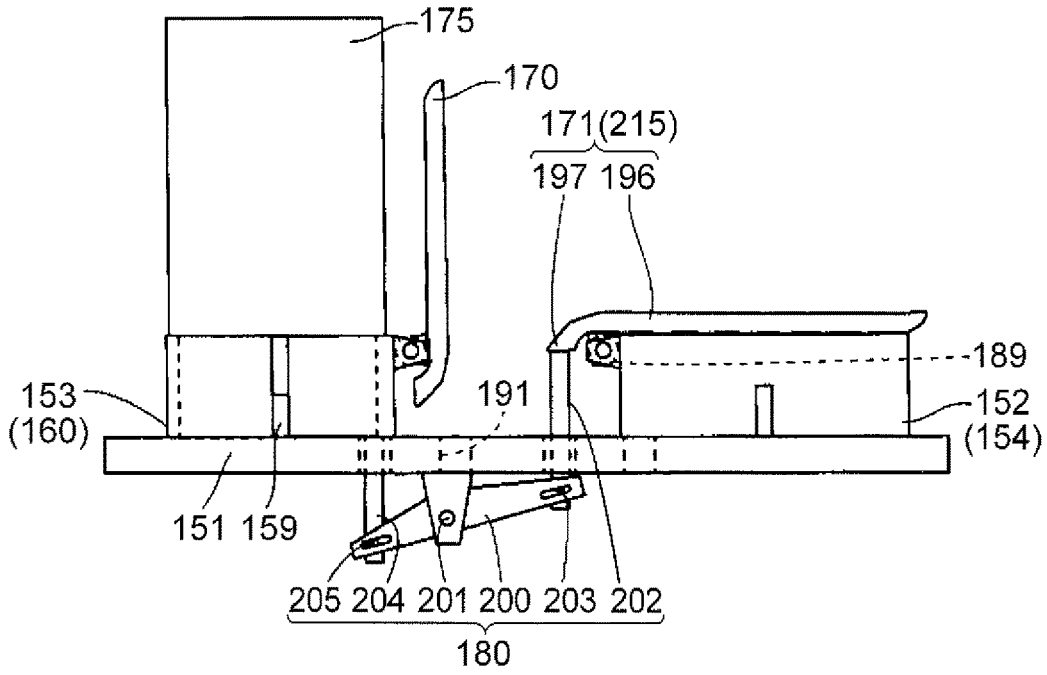
FIG. 25 is a top view illustrating a state where the AC charging connector 175 is connected to a connecting portion 153.

Subsequently, as illustrated in FIG. 25, the AC charging connector 175 is inserted into the connecting portion 153. When the AC charging connector 175 is inserted into the connecting portion 153, the ejection pin 204 is pushed by the AC charging connector 175. When the ejection pin 204 is pushed, the arm 200 rotates, so that the pressing member 202 projects. More specifically, the pressing member 202 projects toward a front-face side from a back-face side of the substrate 151. When the pressing member 202 projects as such, an end portion of the pressing member 202 makes contact with an end portion of the cover 171.

Along with the insertion of the AC charging connector 175, the pressing member 202 presses the cover 171. When the AC charging connector 175 is connected to the connecting portion 153, the cover 171 is positioned at the closed position 212. Note that the AC charging connector 175 is connected to the connecting portion 153 such that a claw portion provided in the AC charging connector 175 is locked by the stopper 159.

As such, when the AC charging connector 175 is connected to the connecting portion 153, the connecting portion 152 is closed by the cover 171. Hereby, at the time when the AC charging connector 175 is connected, it is possible to restrain the DC charging connector 176 from being connected.

Further, in a state where the AC charging connector 175 is connected to the connecting portion 153, the pressing member 202 supports the cover 171 so that the cover 171 is kept positioned at the closed position 212.

Even if an external force is applied to the cover 171, the pressing member 202 is supported by the AC charging connector 175 via the arm 200 and the ejection pin 204. Since the AC charging connector 175 is connected such that the claw portion of the AC charging connector 175 is locked by the stopper 159, even if an external force is applied to the cover 171, the AC charging connector 175 is restrained from falling off from the connecting portion 153.

On this account, in a state where the AC charging connector 175 is connected to the connecting portion 153, even if an external force is applied to the cover 171, the cover 171 is restrained from being opened.

Figure 26:
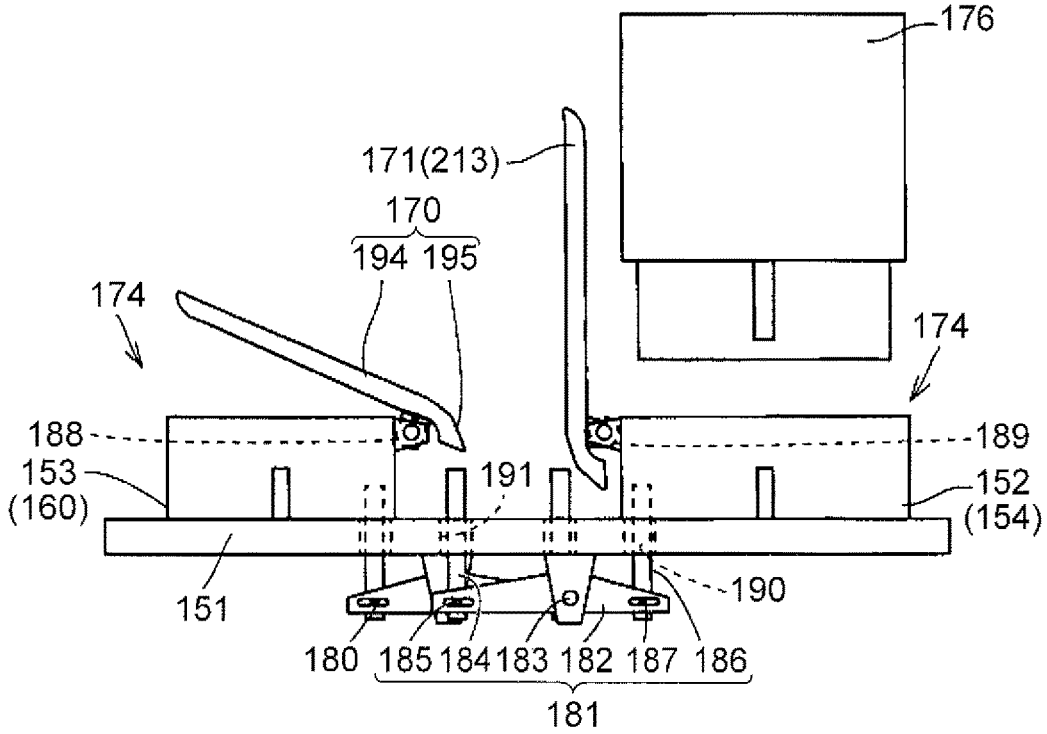
FIG. 26 is a top view illustrating a state where a cover 171 is opened to an open position 213 by a DC charging connector 176.

Next will be described a case where the DC charging connector 176 is connected to the connecting portion 152. Initially, as illustrated in FIG. 26, the cover 171 is pushed to be opened by the DC charging connector 176, so as to rotate the cover 171 to the open position 213.

Figure 27:
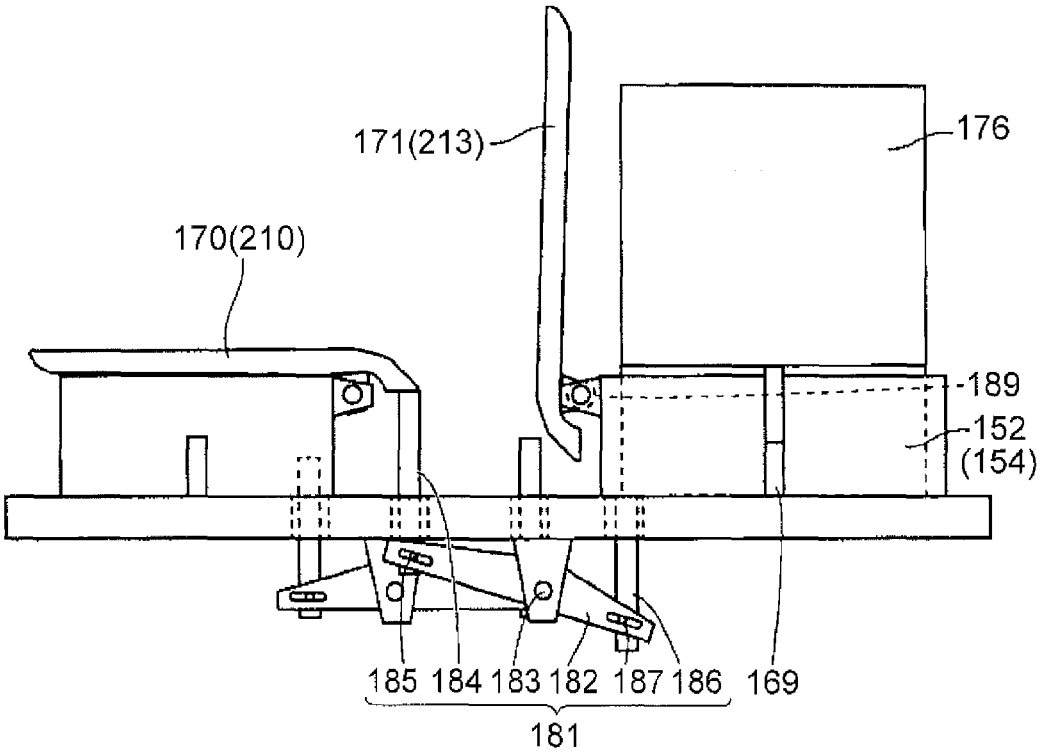
FIG. 27 is a top view illustrating a state where the DC charging connector 176 is connected to a connecting portion 152.

Subsequently, as illustrated in FIG. 27, the DC charging connector 176 is inserted into the connecting portion 152. When the DC charging connector 176 is inserted into the connecting portion 152, the DC charging connector 176 presses the ejection pin 186. When the ejection pin 186 is pressed, the arm portion 182 rotates. When the arm portion 182 rotates, the pressing member 184 projects in a direction toward the front-face side from the back-face side of the substrate 151, so as to press an end portion of the cover 170.

Then, along with the insertion of the DC charging connector 176, the pressing member 184 moves the cover 170 toward the closed position 210. As illustrated in FIG. 27, when the DC charging connector 176 is connected to the connecting portion 152, the cover 170 is positioned at the closed position 210. Note that the DC charging connector 176 is connected to the connecting portion 152 such that a claw portion provided in the DC charging connector 176 is locked by the stopper 169.

Here, in a state where the DC charging connector 176 is connected to the connecting portion 152, the pressing member 184 presses the cover 170 so that the cover 170 is kept positioned at the closed position 210. In a state where the DC charging connector 176 is connected to the connecting portion 152, even if an external force is applied to the cover 170, it is possible to restrain the cover 170 from being opened.

More specifically, the pressing member 184 is supported by the DC charging connector 176 via the arm portion 182 and the ejection pin 186. Since the claw portion of the DC charging connector 176 is locked by the stopper 169, even if an external force is applied to the cover 170, the DC charging connector 176 is restrained from falling off from the connecting portion 152. Hereby, the state where the pressing member 184 presses the cover 170 is maintained, so that the cover 170 is kept positioned at the closed position 210.

As such, even with the charging connector connecting device 150 according to the Embodiment 2, in a state where each charging connector is connected to each connecting portion, it is possible to restrain such a situation that a cover for a connecting portion to which no charging connector is connected is opened.

As such, the embodiments can be applied to a charging connector connecting device that can perform AC charging and DC charging of a combo system, and a charging connector connecting device that can perform AC charging and DC charging of a CHAdeMO system.

The embodiments have been described above, but what has been described herein is just an example and is not limiting.

What is claimed is:

1. A charging connector connecting device comprising:

a connector connecting portion including a first connecting portion and a second connecting portion, the connector connecting portion being configured to be selectively connected to either a first charging connector that is inserted into the first connecting portion or a second charging connector that is inserted into the first connecting portion and the second connecting portion;

a cover that is movable between a closed position at which the second connecting portion is closed and an open position at which the second connecting portion is opened for connection to the second charging connector;

an elastic member configured to apply a biasing force to the cover so that the cover is positioned at an initial position between the closed position and the open position; and a pressing member configured to move with insertion of the first charging connector into the connector connecting portion so as to press the cover positioned at the initial position to thereby move the cover to the closed position, wherein when the first charging connector is connected to the first connecting portion, the pressing member engages the cover to maintain the cover at the closed position.

2. The charging connector connecting device according to claim 1, wherein the pressing member is configured to move with insertion of the second charging connector while the cover is positioned at the open position so as to be spaced from the cover positioned at the open position.

3. The charging connector connecting device according to claim 1, further comprising:

an arm provided on a back-face side of the connector connecting portion, the back-face side being opposite to a front-face side of the connector connecting portion into which the first charging connector and the second charging connector are selectively inserted;

a support configured to swingably support the arm portion; and a projection provided in the arm so as to project from the arm such that the projection projects toward the front-face side from the back-face side of the connector connecting portion, wherein:

the pressing member is provided on an opposite side of the support relative to the projection;

the projection is provided at a position where the projection is pressed by the first charging connector or the second charging connector when inserted into the connector connecting portion;

the arm is configured to rotate when the projection is pressed by the first charging connector or the second charging connector, to cause the pressing member to move in a direction toward the front-face side from the back-face side; and the pressing member is configured to move in the direction toward the front-face side from the back-face side to press the cover positioned at the initial position.

4. The charging connector connecting device according to claim 1, wherein:

the cover is rotatably attached to a lower end side of the second connecting portion; and the cover positioned at the initial position is in a state where its upper end is spaced from the second connecting portion.

5. The charging connector connecting device according to claim 1, wherein the cover includes support walls that support side faces of the second charging connector when the second charging connector is inserted into the connector connecting portion.

6. The charging connector connecting device according to claim 1, further comprising:

a detector configured to detect that the first charging connector or the second charging connector is inserted into the connector connecting portion; and an actuator configured to move the pressing member, wherein:

the connector connecting portion includes a front face into which the first charging connector or the second charging connector is inserted, and a back face positioned on an opposite side to the front face; and the actuator is configured to move the pressing member from the back-face side toward the front-face side when the first charging connector or the second charging connector is inserted into the connector connecting portion.

7. A charging connector connecting device comprising:

a connector connecting portion including a first connecting portion configured to connect to a first charging connector, and a second connecting portion configured to connect to a second charging connector;

a second connecting portion cover that is movable between a closed position at which the second connecting portion is closed and an open position at which the second connecting portion is opened for connection to the second charging connector;

a second cover elastic member configured to apply a biasing force to the second connecting portion cover so that the second connecting portion cover is positioned at an initial position between the closed position and the open position; and a second cover pressing member configured to move with insertion of the first charging connector into the first connecting portion, so as to press the second connecting portion cover positioned at the initial position to thereby move the second connecting portion cover to the closed position, the second cover pressing member being configured such that, when the first charging connector is connected to the first connecting portion, the second cover pressing member engages the second connecting portion cover to maintain the second connecting portion cover at the closed position.

8. The charging connector connecting device according to claim 7, further comprising:

a first connecting portion cover that is movable between a closed position at which the first connecting portion is closed and an open position at which the first connecting portion is opened for connection to the first charging connector;

a first cover elastic member configured to apply a biasing force to the first connecting portion cover so that the first connecting portion cover is positioned at an initial position between the closed position of the first connecting portion cover and the open position of the first connecting portion cover; and a first cover pressing member configured to move with insertion of the second charging connector into the second connecting portion, so as to press the first connecting portion cover positioned at the open position of the first connecting portion cover to thereby move the first connecting portion cover to the closed position of the first connecting portion cover, wherein when the second charging connector is connected to the second connecting portion, the first cover pressing member engages the first connecting portion cover to maintain the first connecting portion cover at the closed position of the first connecting portion cover.

* * * * *